US007813675B2

(12) United States Patent
Tanabe et al.

(10) Patent No.: US 7,813,675 B2
(45) Date of Patent: Oct. 12, 2010

(54) ELECTROPHOTOGRAPHIC PHOTOSENSITIVE MEMBER, PROCESS CARTRIDGE, AND ELECTROPHOTOGRAPHIC APPARATUS

(75) Inventors: Kan Tanabe, Toride (JP); Yoshihisa Saito, Toride (JP); Hideki Ogawa, Moriya (JP); Shoji Amamiya, Kashiwa (JP); Tatsuya Ikezue, Toride (JP); Takahiro Mitsui, Kawasaki (JP); Mayumi Oshiro, Abiko (JP); Kumiko Takizawa, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/324,040

(22) Filed: Nov. 26, 2008

(65) Prior Publication Data

US 2009/0074460 A1 Mar. 19, 2009

Related U.S. Application Data

(63) Continuation of application No. PCT/JP2008/063725, filed on Jul. 24, 2008.

(30) Foreign Application Priority Data

Jul. 26, 2007 (JP) ..... 2007-194726

(51) Int. Cl.
*G03G 15/00* (2006.01)
*G03G 5/00* (2006.01)

(52) U.S. Cl. ..... 399/159; 430/56; 430/66

(58) Field of Classification Search ..... 430/56, 430/66, 130, 132, 133; 399/159
See application file for complete search history.

(56) References Cited

U.S. PATENT DOCUMENTS

| | | | | |
|---|---|---|---|---|
| 5,114,814 | A | 5/1992 | Sakoh et al. | 430/46 |
| 5,242,773 | A | 9/1993 | Iino et al. | |
| 5,242,776 | A | 9/1993 | Doi et al. | 430/67 |
| 2005/0255393 | A1 | 11/2005 | Nakata et al. | 430/56 |
| 2006/0008717 | A1 | 1/2006 | Uematsu et al. | 430/56 |
| 2006/0019185 | A1 | 1/2006 | Amamiya et al. | 430/66 |
| 2007/0254232 | A1* | 11/2007 | Kawahara et al. | 430/119.71 |

FOREIGN PATENT DOCUMENTS

| | | |
|---|---|---|
| JP | 53-092133 | 8/1978 |
| JP | 57-094772 | 6/1982 |
| JP | 01-099060 | 4/1989 |
| JP | 02-150850 | 6/1990 |
| JP | 04-175759 | 6/1992 |
| JP | 05-333757 | 12/1993 |
| JP | 06-148910 | 5/1994 |
| JP | 08-202242 | 8/1996 |
| JP | 2001-066814 | 3/2001 |
| JP | 2003-262966 | 9/2003 |
| WO | WO 2005/093518 A1 | 10/2005 |

OTHER PUBLICATIONS

ESP@CENET English-language abstract describing JP 52-026226 (pub. Feb. 1977).*
ESP@CENET English-language abstract describing JP 02-139566 (pub. May 1990).*
Diamond, A. S., ed., Handbook of Imaging Materials, Marcel Dekker, Inc., NY (1991), pp. 395-396.*
USPTO English-language translation of JP 2001-066814 (pub. Mar. 16, 2001).*
International Preliminary Report on Patentability in PCT/JP2008/063725 dated Feb. 4, 2010, and translation, 10 pages.

* cited by examiner

*Primary Examiner*—Janis L Dote
(74) *Attorney, Agent, or Firm*—Fitzpatrick, Cella, Harper & Scinto

(57) ABSTRACT

An electrophotographic photosensitive member is provide which inhibits recovered toner from leaking out of the edge portion at the time of long-term use, and has good durability. Each of at least both edge portions of the surface layer of the electrophotographic photosensitive member has a region in which independent depressed portions are formed at a density of ten or more portions per 100 μm square. An average depth Rdv-A, an average short axis diameter Lpc-A, and an average long axis diameter Rpc-A, of the depressed portions are respectively in specific ranges. When an angle formed between the circumferential direction of the electrophotographic photosensitive member and the long axis of each of the depressed portions is represented by θ, the depressed portions are formed so that the angle θ satisfies the relationship of 90°<θ<180° toward the center of the electrophotographic photosensitive member.

4 Claims, 17 Drawing Sheets

ELECTROPHOTOGRAPHIC PHOTOSENSITIVE MEMBER, PROCESS CARTRIDGE, AND ELECTROPHOTOGRAPHIC APPARATUS

This application is a continuation of International Application No. PCT/JP2008/063725, filed on Jul. 24, 2008, which claims the benefit of Japanese Patent Application No. 2007-194726 filed on Jul. 26, 2007.

BACKGROUND OF THE INVENTION

1. Field of the Invention

The present invention relates to an electrophotographic photosensitive member, and a process cartridge and an electrophotographic apparatus each having the electrophotographic photosensitive member.

2. Description of the Related Art

An electrophotographic photosensitive member is generally used together with a developer in a series of electrophotographic image forming processes including charging, exposure, development, transfer, and cleaning. In the processes, toner in the developer is developed onto the surface of the electrophotographic photosensitive member by a developing unit, and is then transferred onto a transfer material by a transferring unit. However, toner remaining on the surface of the electrophotographic photosensitive member even after the transferring step (hereinafter referred to as "transfer residual toner") is present. The transfer residual toner is removed from the surface of the electrophotographic photosensitive member by a cleaning unit in an electrophotographic image forming process using the cleaning unit. The cleaning unit is, for example, a method involving bringing a cleaning blade composed of an elastic body such as a urethane rubber into contact with the electrophotographic photosensitive member to scrape the transfer residual toner. Alternatively, for example, a method involving the use of a fur brush or a method involving the combined use of the cleaning blade and the fur brush is available, and a method involving the use of the cleaning blade has been widely employed because of its simplicity and effectiveness.

An electrophotographic photosensitive member in which a photosensitive layer (organic photosensitive layer) using an organic material as a photoconductive substance (a charge generation substance or a charge transport substance) is formed on a support, the so-called organic electrophotographic photosensitive member, has been currently in widespread use from the viewpoints of, for example, its low price and high productivity. Of those organic electrophotographic photosensitive members, a mainstream organic electrophotographic photosensitive member is of a lamination type photosensitive layer obtained by superimposing: a charge generating layer containing a charge generation substance such as a photoconductive dye or a photoconductive pigment; and a charge transporting layer containing a charge transport substance such as a photoconductive polymer or a photoconductive low-molecular-weight compound. The mainstream organic electrophotographic photosensitive member has been used because of its advantages including high sensitivity and the diversity of material designs.

Active investigations have been currently conducted on the improvement of the layer serving as the outermost surface of an electrophotographic photosensitive member (hereinafter referred to as "surface layer") with a view to improving the durability of the electrophotographic photosensitive member or suppressing the degradation of the quality of an image formed with the electrophotographic photosensitive member irrespective of whether the electrophotographic photosensitive member is of a single-layered type or a lamination type. To be specific, investigations have been made into, for example, the improvement of a resin for the surface layer and the addition of a filler or water repellent material as approaches from a material aspect from the viewpoints of, for example, an increase in strength of the surface layer and the impartment of high releasability or sliding property to the surface layer.

Meanwhile, investigations have been made into an improvement in transfer efficiency of the electrophotographic photosensitive member, the suppression of image defects due to, for example, cleaning failure, and the solution of problems such as the chattering and turn-up of a cleaning blade by moderate roughening of the surface layer as approaches from a physical aspect. The chattering of the cleaning blade is a phenomenon in which the cleaning blade vibrates owing to an increase in frictional resistance between the cleaning blade and the peripheral surface of an electrophotographic photosensitive member. In addition, the turn-up of the cleaning blade is a phenomenon in which the cleaning blade is reversed in the direction in which the electrophotographic photosensitive member moves.

Various techniques for roughening the surface layer by a physical means are available. For example, Patent Document 1 discloses a technique for causing the surface roughness (roughness of the peripheral surface) of an electrophotographic photosensitive member to fall within a specified range for facilitating the separation of a transfer material from the surface of the electrophotographic photosensitive member. To be specific, Patent Document 1 discloses a method of roughening the surface of an electrophotographic photosensitive member in an orange peel fashion by controlling a drying condition upon formation of the surface layer of the electrophotographic photosensitive member. In addition, Patent Document 2 discloses a technique for roughening the surface of an electrophotographic photosensitive member by incorporating a particle into the surface layer of the electrophotographic photosensitive member. In addition, Patent Document 3 discloses a technique for roughening the surface of an electrophotographic photosensitive member by abrading the surface of the surface layer of the electrophotographic photosensitive member with a metallic wire brush. In addition, Patent Document 4 discloses a technique in which a specific cleaning means and specific toner are used and the surface of an organic electrophotographic photosensitive member is roughened. The document aims to solve, with the technique, the reversal (turning-up) of a cleaning blade and the chipping of an edge portion of the cleaning blade which become problems when the organic electrophotographic photosensitive member is used in an electrophotographic apparatus having a specific process speed or higher. In addition, Patent Document 5 discloses a technique for roughening the surface of an electrophotographic photosensitive member by abrading the surface of the surface layer of the electrophotographic photosensitive member with a filmy abrasive. In addition, Patent Document 6 discloses a technique for roughening the peripheral surface of an electrophotographic photosensitive member by blast treatment. However, details about the surface shapes of the electrophotographic photosensitive members disclosed in Patent Documents 1 to 6 described above are unknown.

Meanwhile, a technique for forming predetermined dimple shapes on the surface of an electrophotographic photosensitive member by controlling the surface shape of the electrophotographic photosensitive member has also been disclosed (see Patent Document 7). In addition, for example, Patent Document 8 discloses a technique for subjecting the surface of an electrophotographic photosensitive member to compression molding with a stamper having well-like irregularities. The technique is expected to be extremely effective against the above-mentioned problems from the following viewpoint of forming independent irregularities on the surface of the electrophotographic photosensitive member with higher controllability than that the techniques disclosed in Patent Documents 1 to 6 described above. According to Patent Document 8, the formation of well-like irregularities having a length or pitch of 10 to 3,000 nm on the surface of an electrophotographic photosensitive member improves the releasability of toner, whereby the nip pressure of a cleaning blade can be reduced, and as a result, the wear of the electrophotographic photosensitive member can be reduced.

When a cleaning blade is used as the cleaning means, for example, such members as described below are generally used in combination with the cleaning blade. First, a sheet member is used, which is placed on the upstream side in the direction in which the electrophotographic photosensitive member moves with respect to the cleaning blade so as to come in weak contact with the surface of the electrophotographic photosensitive member for scooping transfer residual toner scraped by the cleaning blade. A seal member for sealing gaps among the electrophotographic photosensitive member, the cleaning blade, the sheet member, and a cleaning frame is also used in combination at both edge portions in the longitudinal direction of the cleaning blade. The seal member serves to prevent the transfer residual toner (recovered toner) scraped by the cleaning blade from leaking out of a recovered toner container from the gap portions.

However, when the dimensions of a portion where the seal member comes in close contact with the cleaning frame or the cleaning blade vary, a gap arises between the seal member and the cleaning frame or the cleaning blade which should essentially be in close contact with each other, and a problem occurs in that the recovered toner leaks little by little out of the gap during printing. In addition, the seal member must be precisely set in the cleaning frame lest such leakage of the recovered toner should occur. Accordingly, there has been a problem in terms of setting workability as well.

To cope with those problems, efforts have been made to enhance the sealing property and setting property of the seal member by improving the seal member (see Patent Document 9).

Patent Document 1: Japanese Patent Application Laid-Open No. S53-092133

Patent Document 2: Japanese Patent Application Laid-Open No. S52-026226

Patent Document 3: Japanese Patent Application Laid-Open No. S57-094772

Patent Document 4: Japanese Patent Application Laid-Open No. H01-099060

Patent Document 5: Japanese Patent Application Laid-Open No. H02-139566

Patent Document 6: Japanese Patent Application Laid-Open No. H02-150850

Patent Document 7: International Publication No. WO2005/093518

Patent Document 8: Japanese Patent Application Laid-Open No. 2001-066814

Patent Document 9: Japanese Patent Application Laid-Open No. H08-202242

SUMMARY OF THE INVENTION

However, in Patent Documents 7 and 8 described above, it is unknown what type of anisotropy each of the dimple shapes or the independent irregularities formed on the surface of the electrophotographic photosensitive member has with respect to the in-plane direction of the surface of the electrophotographic photosensitive member. Details about what type of positional relationship the individual dimple shapes or the individual independent irregularities are arrayed with are also unknown.

In addition, in recent years, a reduction in diameter of toner particles for an increase in resolution has advanced in accordance with a request for an additional improvement in quality of an image formed with an electrophotographic apparatus. Upon use of the toner containing particles having a reduced diameter, an additional improvement in sealing property at both edge portions of a cleaning member has been requested for the suppression of the leakage of recovered toner. Accordingly, the current technique for the suppression of the leakage of recovered toner is still susceptible to improvement.

The present invention has been made in view of the above-mentioned problems, and an object of the present invention is to provide an electrophotographic photosensitive member in which toner leakage at an OPC edge portion region hardly occurs, and a process cartridge and an electrophotographic apparatus each having the electrophotographic photosensitive member.

The inventors of the present invention have made extensive studies on toner leakage occurring at an edge portion region of an electrophotographic photosensitive member. As a result, the inventors have found that the above-mentioned problems can be effectively alleviated by forming predetermined fine depressed portions in at least both edge portions of the surface layer of the electrophotographic photosensitive member. Details about the foregoing are described below.

The present invention is directed to an electrophotographic photosensitive member including a support and a photosensitive layer formed on the support, wherein each of at least both edge portions of a surface layer of the electrophotographic photosensitive member has a region in which depressed portions independent of each other are formed at a density of ten or more portions per 100 μm square; when an average depth representing a distance between a deepest portion and an opening of each of the depressed portions is represented by Rdv-A, an average short axis diameter of the depressed portions is represented by Lpc-A, and an average long axis diameter of the depressed portions is represented by Rpc-A, the average depth Rdv-A falls within a range of 0.3 μm or more and 4.0 μm or less, the average short axis diameter Lpc-A falls within a range of 2.0 μm or more and 10.0 μm or less, and the average long axis diameter Rpc-A is twice or more as long as the average short axis diameter Lpc-A and 50 μm or less; and when an angle formed between a circumferential direction of the electrophotographic photosensitive member and a long axis of each of the depressed portions is represented by θ, the depressed portions are formed in both edge portions of the electrophotographic photosensitive member so that the angle θ satisfies a relationship of $90° < \theta < 180°$ toward a center of the electrophotographic photosensitive member. In addition, the electrophotographic photosensitive member is characterized in that the angle θ satisfies a relationship of $100° \leqq \theta \leqq 170°$. In addition, the electrophotographic photosensitive member is characterized in that the depressed portions are arranged so that another depressed portion is present on a line drawn from an edge portion in a long axis direction of an arbitrary depressed portion along the circumferential direction of the electrophotographic photosensitive member in each of the regions in which the depressed portions are formed.

The present invention is directed also to a process cartridge which integrally supports the electrophotographic photosensitive member described above and at least one unit selected from the group consisting of a charging unit, a developing unit, and a cleaning unit for removing transfer residual toner by bringing an elastic member into contact with the electrophotographic photosensitive member, and is detachably mountable on a main body of an electrophotographic apparatus, wherein the angle θ is an angle formed between a rotational movement direction of the electrophotographic photosensitive member and the long axis of each of the depressed portions.

Furthermore, the present invention is directed to an electrophotographic apparatus including the electrophotographic photosensitive member described above, a charging unit, a developing unit, a transferring unit, and a cleaning unit for removing transfer residual toner by bringing an elastic member into contact with the electrophotographic photosensitive member, wherein the angle θ is an angle formed between a rotational movement direction of the electrophotographic photosensitive member and the long axis of each of the depressed portions. In addition, the electrophotographic apparatus is characterized in that the regions where the depressed portions are formed are arranged to be present outside a largest region where a toner image is formed. In addition, the electrophotographic apparatus is characterized in that a toner to be used in the developing unit has a weight average particle diameter of 5.0 μm or more.

According to the present invention, there can be provided an electrophotographic photosensitive member in which the leakage of recovered toner from an edge portion region of the electrophotographic photosensitive member hardly occurs, and a process cartridge and an electrophotographic apparatus each having the electrophotographic photosensitive member.

Further features of the present invention will become apparent from the following description of exemplary embodiments with reference to the attached drawings.

DESCRIPTION OF REFERENCE CHARACTERS

Figure 1A:
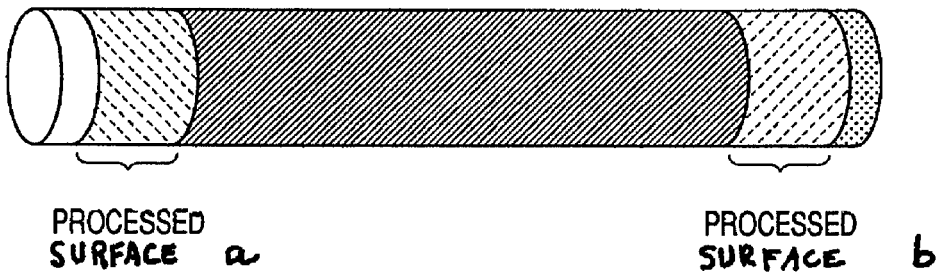
FIG. 1A is a view showing an example of an electrophotographic photosensitive member subjected to fine surface processing.

| | |
|---|---|
| 1 | surface of electrophotographic photosensitive member |
| 2 | depressed portion |

-continued

DESCRIPTION OF REFERENCE CHARACTERS

| | |
|---|---|
| 3 | Lpc |
| 4 | Rpc |
| 5 | θ |
| 6 | Rdv |
| 7 | depressed portion satisfying the relationship of Rpc ≧ 2Lpc |
| 8 | depressed portion not satisfying the relationship of Rpc ≧ 2Lpc |
| 9 | electrophotographic photosensitive member |
| 10 | axis |
| 11 | charging unit |
| 12 | exposure light |
| 13 | developing unit |
| 14 | transferring unit |
| 15 | cleaning means |
| 16 | fixing unit |
| 17 | process cartridge |
| 18 | guiding unit |
| 19 | cleaning blade |
| 20 | cleaning frame |
| 21 | sheet member |
| 22 | seal member |
| 23 | CCD camera |
| 24 | monitor |
| 25 | video recorder |
| 26 | microscope (light source) |
| 27 | microscope (objective lens) |
| 28 | glass substrate |
| 29 | surface layer |
| 30 | depressed portion on surface layer |
| 31 | cleaning blade |
| 32 | blade support sheet metal |
| 33 | toner particle (cyan) |
| 34 | toner particle (magenta) |
| 35 | layer principally consisting of toner |
| 36 | toner particle adhering to surface layer before cleaning |
| 37 | toner particle moving in lateral direction due to depressed form of surface layer |
| 38 | mold surface (non-projected portion) |
| 39 | projected portion |
| 40 | short axis of projected portion |
| 41 | long axis of projected portion |
| 42 | θ |
| 43 | height of projected portion |
| 44 | vertical interval between projected portions |
| 45 | lateral interval between projected portions |
| 46 | vertical shift width between adjacent projected portions |
| a | laser light shielding portion |
| b | laser light transmitting portion |
| c | excimer laser light irradiator |
| d | motor for work rotation |
| e | work moving device |
| f | photosensitive member drum |
| A | pressure device |
| B | mold |
| C | photosensitive member |
| P | transfer material |

DESCRIPTION OF THE EMBODIMENTS

Hereinafter, an electrophotographic photosensitive member (in the figures, abbreviated as E.P. MEMBER) of the present invention will be described in detail with reference to the drawings.

First, the surface shape of the electrophotographic photosensitive member of the present invention will be described.

The electrophotographic photosensitive member of the present invention has a photosensitive layer formed on a conductive substrate, and depressed portions independent of each other are formed at a density of ten or more portions per 100 μm square in at least both edge portions of the surface layer of the photosensitive layer. FIG. 1A shows an example of the electrophotographic photosensitive member of the present invention. As indicated by processed surfaces a and b of FIG. 1A, the depressed portions of the present invention are formed in both edge portions of the electrophotographic photosensitive member.

In addition, when an average depth representing a distance between the deepest portion and opening of each of the depressed portions is represented by Rdv-A, an average short axis diameter of the depressed portions is represented by Lpc-A, and an average long axis diameter of the depressed portions is represented by Rpc-A, they fall within the following ranges: the average depth Rdv-A falls within the range of 0.3 μm or more to 4.0 μm or less, the average short axis diameter Lpc-A falls within the range of 2.0 μm or more to 10.0 μm or less, and the average long axis diameter Rpc-A is twice or more as long as the average short axis diameter Lpc-A and 50 μm or less.

Here, the depressed portions are formed so that an angle θ formed between the long axis of each of the depressed portions and the circumferential direction of the electrophotographic photosensitive member satisfies the relationship of $90° < \theta < 180°$. In addition, the angle θ is an angle measured from the rotational movement direction of the electrophotographic photosensitive member toward the center in the longitudinal direction of a region of the electrophotographic photosensitive member to be used in image formation in an electrophotographic apparatus or process cartridge.

Therefore, when the entirety of the electrophotographic photosensitive member is observed, each of the depressed portions formed in both the edge portions of the electrophotographic photosensitive member is formed so as to face toward a direction opposite to the circumferential direction of the electrophotographic photosensitive member because the reference direction in which the angle θ is measured is reversed left to right (or upside down) in each of the edge portions.

Figure 1B:
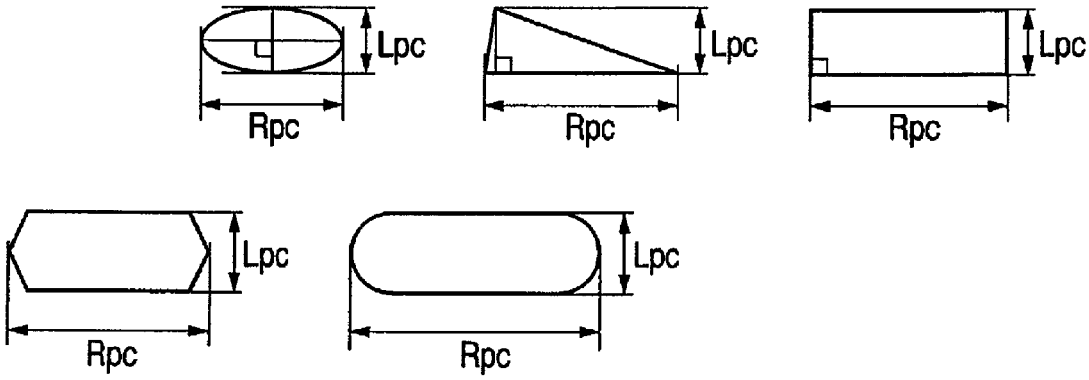
FIG. 1B shows examples of the surface (opening) shape of a depressed portion.
Figure 1C:
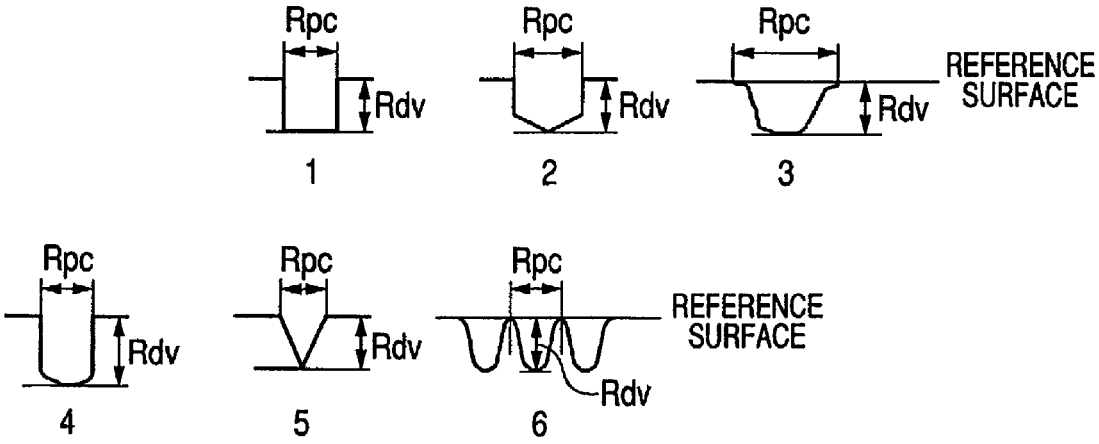
FIG. 1C shows examples of the sectional shape of a depressed portion.

FIGS. 1B and 1C show an example of the surface of the electrophotographic photosensitive member of the present invention, and specific surface and sectional shapes of each depressed portion. The surface shape of each depressed portion can be formed into any one of various shapes such as an ellipse, a polygon such as a triangle, a square, and a hexagon, and a shape in which a polygonal edge or side is partially or entirely curved as illustrated in FIG. 1B. In addition, the sectional shapes of each depressed portion can be formed into any one of various shapes such as a shape having a triangular, quadrangular, or polygonal edge, a wave form formed of a continuous curve, and a shape in which the triangular, quadrangular, or polygonal edge is partially or entirely curved as illustrated in FIG. 1C. All of multiple depressed portions to be formed in the surface of the electrophotographic photosensitive member may be identical to each other in shape, size, depth, and angle θ. Alternatively, the depressed portions having different shapes, different sizes, different depths, and different angle θ may be formed in combination.

Next, the average short axis diameter Lpc-A and the average long axis diameter Rpc-A will be described. First, a short axis diameter Lpc in a depressed portion composed of a composite shape of part or the entirety of an edge or side of a polygon or an ellipse and a curve is defined as the length of the shortest straight line out of the straight lines obtained by horizontally projecting a surface opening portion in each depressed portion as shown in FIG. 1B. For example, a minor diameter is adopted in the case of an ellipse, and a shorter side is adopted in the case of a rectangle. Next, a long axis diameter Rpc is defined as the length of a straight line obtained by projecting the surface opening portion of each depressed portion in the lengthwise direction of the short axis diameter Lpc. For example, a major diameter is adopted in the case of an ellipse, and a longer side is adopted in the case of a rectangle. As can be seen from a rectangle example, the long axis diameter Rpc in the present invention does not necessarily coincide with the length of the longest straight line out of the straight lines obtained by horizontally projecting the surface opening portion of each depressed portion (a diagonal line in the case of a rectangle).

Upon measurement of the short axis diameter Lpc, in, for example, the case where a boundary between a depressed portion and a flat portion is unclear like 3 of FIG. 1C, the opening portion of the depressed portion is defined with reference to a smooth surface before roughening in consideration of the sectional shape of the depressed portion, and the short axis diameter Lpc is determined by the above-mentioned method. After that, the long axis diameter Rpc is determined in imitation of the above-mentioned method.

The average of the short axis diameters Lpc's of all depressed portions in a 100 μm square measurement region thus obtained is defined as the average short axis diameter Lpc-A, and the average of the long axis diameters Rpc's of all the depressed portions is defined as the average long axis diameter Rpc-A.

Next, the average depth Rdv-A representing a distance between the deepest portion and opening of each of the depressed portions will be described. A depth Rdv in the present invention represents a distance between the deepest portion and opening of each of the depressed portions. To be specific, as indicated by the depth Rdv of FIG. 1C, the depth refers to a distance between the deepest portion and opening of each depressed portion in the electrophotographic photosensitive member with reference to a surface around the opening portion of the depressed portion.

The depths Rdv's of all the depressed portions in the above-mentioned measurement region are measured as described above, and the average of all the measured Rdv's is defined as the average depth Rdv-A.

In the present invention, the average short axis diameter Lpc-A is preferably 2.0 μm or more and 10.0 μm or less, or more preferably 3.0 μm or more and 10.0 μm or less. The average long axis diameter Rpc-A is twice or more as long as the average short axis diameter Lpc-A and 50 μm or less. The average depth Rdv-A is preferably 0.3 μm or more and 4.0 μm or less, or more preferably 0.5 μm or more and 4.0 μm or less.

Although the reason why the use of the electrophotographic photosensitive member of the present invention suppresses the occurrence of the leakage of recovered toner from an edge portion region of the electrophotographic photosensitive member is not completely elucidated, the reason is assumed to be as described below. First, when the transfer residual toner on the surface of the electrophotographic photosensitive member of the present invention is cleaned by a cleaning member, the transfer residual toner is brought into such a state as to be temporarily caught in the depressed portions formed in the surface of the electrophotographic photosensitive member. When the transfer residual toner in this state bumps against the cleaning member or a deposit present in a nip portion between the cleaning member and the surface of the electrophotographic photosensitive member, such an action as to sweep away the transfer residual toner along the longitudinal direction of each of the depressed portions is considered to arise. Here, the angle θ formed between the long axis of each of the depressed portions and the circumferential direction of the electrophotographic photosensitive member is set so that the transfer residual toner is swept away toward the center of the image formation region of the electrophotographic photosensitive member. Thus, the transfer residual toner flowing toward an edge portion of the electrophotographic photosensitive member is reduced, thereby suppressing the occurrence of the leakage of the recovered toner from an edge portion region of the electrophotographic photosensitive member.

As described above, the direction in which the long axis diameter Rpc faces corresponds to the direction in which the cleaning member sweeps away the transfer residual toner. Accordingly, the direction in which the cleaning member sweeps away the transfer residual toner is required to face toward the center of the electrophotographic photosensitive member in order that the leakage of the toner from an edge portion region of the electrophotographic photosensitive member can be suppressed. In the present invention, an angle formed between the direction of the long axis diameter Rpc of each depressed portion and the circumferential direction of the electrophotographic photosensitive member is represented by θ. Then, a rotational movement direction in the circumferential direction of the electrophotographic photosensitive member is set to be in a direction of 0=0°, and the angle θ is measured from the direction toward the center in the image formation region of the electrophotographic photosensitive member when viewed from a certain position of the depressed portion. In this case, in the electrophotographic photosensitive member of the present invention, the angle θ must satisfy the relationship of $90° < \theta < 1.80°$. It should be noted that the case of $270° < \theta < 360°$ is substantially identical to the case of $90° \leqq \theta \leqq 180°$, and only the case of $90° < \theta < 180°$ will be described in the present invention for avoiding redundancy.

In the case where the angle θ is 90° or 180°, cannot be expected that the effect of sweeping away the toner toward the center in the longitudinal direction of the electrophotographic photosensitive member is exhibited. In addition, the case of $0° < \theta < 90°$ is not preferable because, in contrast to the present invention, the transfer residual toner swept away toward an edge portion of the electrophotographic photosensitive member increases, and an effect of the present invention is difficult to obtain. Even in the case of $90° < \theta < 180°$, the effect of sweeping away the transfer residual toner toward the center of the image formation region of the electrophotographic photosensitive member is reduced as the angle θ approaches 90° or 180°. Investigations conducted by the inventors of the present invention have revealed that the angle θ in the present invention more preferably satisfies the relationship of $100° \leqq \theta \leqq 170°$.

When the average short axis diameter Lpc-A of the depressed portions in the surface of the electrophotographic photosensitive member is less than 2.0 μm, the extent to which the transfer residual toner is caught in each depressed portion is reduced, and it becomes hard to sufficiently achieve such an effect that the cleaning member brought into contact with the surface of the electrophotographic photosensitive member sweeps away the transfer residual toner in the long axis direction of each depressed portion.

In addition, where the average short axis diameter Lpc-A of depressed portions is less than 2.0 μm, the extent to which an external additive liberated from the toner fills in the depressed portions is enlarged when the electrophotographic photosensitive member is repeatedly used. As a result, the effect of sweeping away the transfer residual toner in a desired direction is reduced. Accordingly, in the present invention, the depressed portions having the average short axis diameter Lpc-A of 2.0 μm or more are preferably used.

On the other hand, when the average short axis diameter Lpc-A exceeds 10.0 μm, the amount of the transfer residual toner entering the depressed portions tends to increase. In such a case, the amount of the transfer residual toner receiving sufficient actions from both an edge portion of each depressed portion and the cleaning member is relatively reduced, and it becomes hard to sufficiently achieve the effect of sweeping away the transfer residual toner in the long axis direction of each depressed portion.

In addition, when the average short axis diameter Lpc-A is increased, the size of the entirety of each depressed portion increases, with the result that the number of depressed portions that can be arranged in a certain area is reduced. In this case, the effect of the present invention is difficult to obtain. On the other hand, when large depressed portions are arranged at a high density, the distance between the edge portions of depressed portions is narrowed, and the strength of the corresponding portion is lowered. In the present invention, depressed portions having the average short axis diameter Lpc-A of 10.0 μm or less are preferably formed at a suitable density because the effect of the present invention is reduced where an edge portion of each depressed portion is broken by the repeated use of the electrophotographic photosensitive member.

When the average depth Rdv-A of the depressed portions in the surface of the electrophotographic photosensitive member is less than 0.3 μm, the extent to which the transfer residual toner catches in an edge portion of each depressed portion becomes insufficient. Accordingly, the effect cannot be sufficiently obtained such that the cleaning member contacting with the surface of the electrophotographic photosensitive member sweeps away the transfer residual toner in the long axis direction of each depressed portion. In addition, when the average depth exceeds 4.0 μm, the extent to which the transfer residual toner entering the depressed portions catches in the cleaning member becomes insufficient, with the result that the effect cannot be sufficiently obtained such that the transfer residual toner is swept away in the long axis direction of each depressed portion.

In addition, in the present invention, each depressed portion should be in an elongated shape in order that the direction in which the transfer residual toner is swept away by the cleaning member or the like may be properly oriented. Accordingly, the average long axis diameter Rpc-A of the depressed portions is preferably twice or more as long as the average short axis diameter Lpc-A and 50 μm or less. When the average long axis diameter Rpc-A is less than twice as long as the average short axis diameter Lpc-A, it becomes hard to sufficiently obtain the effect of the present invention because the effect is reduced such that the transfer residual toner is oriented toward the center of the image formation region.

In addition, the transfer residual toner is required to be removed from the electrophotographic photosensitive member by being scraped away by the cleaning member after having been swept toward the center of the image formation region to some extent. At that time, an edge portion in the direction of the long axis diameter Rpc of each depressed portion serves as a starting point when the transfer residual toner is scraped away. However, when the transfer residual toner deposits intensively at one site of the cleaning member, cleaning failure due to the escape of the toner from the site may occur. Accordingly, starting points for scraping away the transfer residual toner are preferably scattered over a wide range of the surface of the electrophotographic photosensitive member. Accordingly, the average long axis diameter Rpc-A of the depressed portions in the electrophotographic photosensitive member of the present invention is preferably less than 50 μm, and the depressed portions satisfying the above requirements are formed at a density of preferably ten or more portions, or more preferably twenty or more portions, per 100 μm square.

The electrophotographic photosensitive member of the present invention, which has the depressed portions according to the present invention in at least both the edge portions of the surface layer of the photosensitive layer, may have depressed portions different from those in the present invention together. Even in such a case, the effect of the present invention can be obtained as long as the action of the depressed portions satisfying the requirements of the present invention is dominant.

Figure 1D:
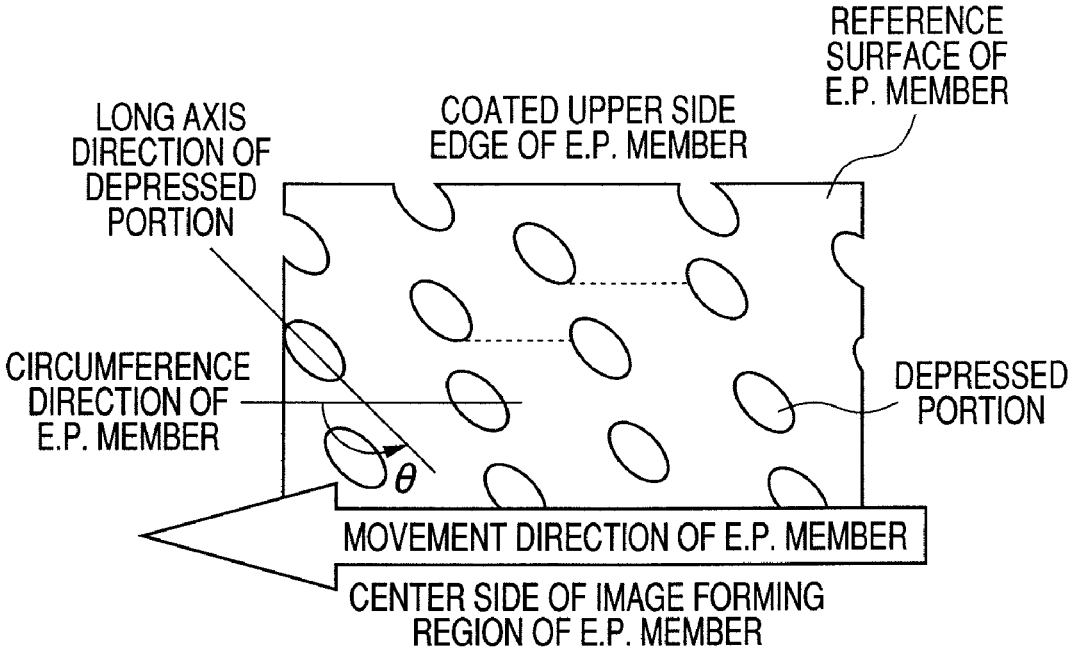
FIG. 1D is a view showing an example in which depressed portions are arranged on a coated upper edge side of the electrophotographic photosensitive member.
Figure 1E:
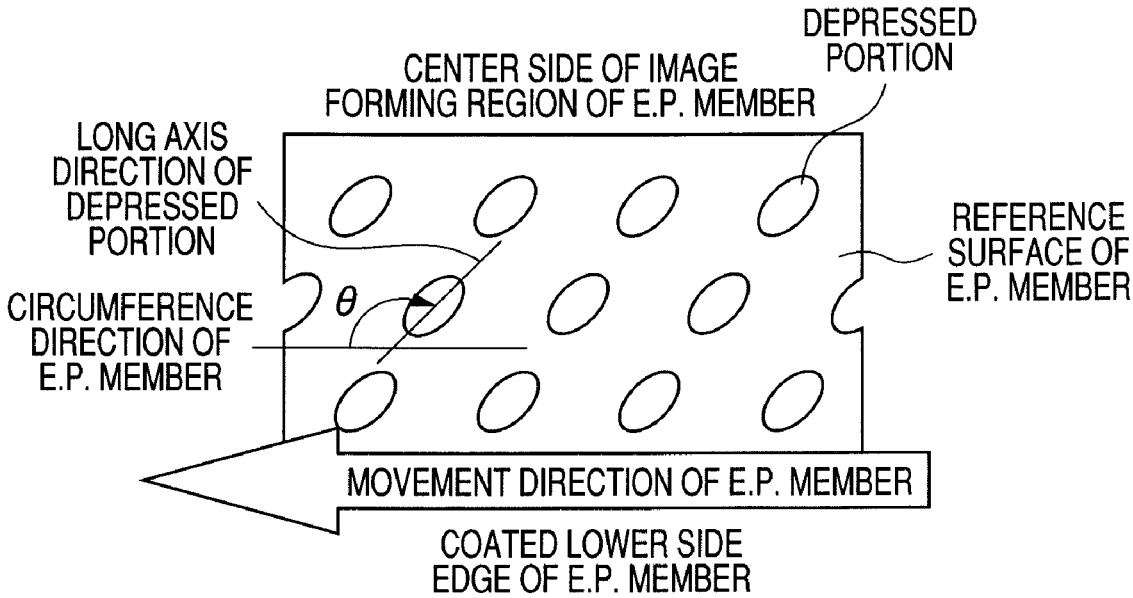
FIG. 1E is a view showing an example in which depressed portions are arranged on a coated lower edge side of the electrophotographic photosensitive member.
Figure 2A:
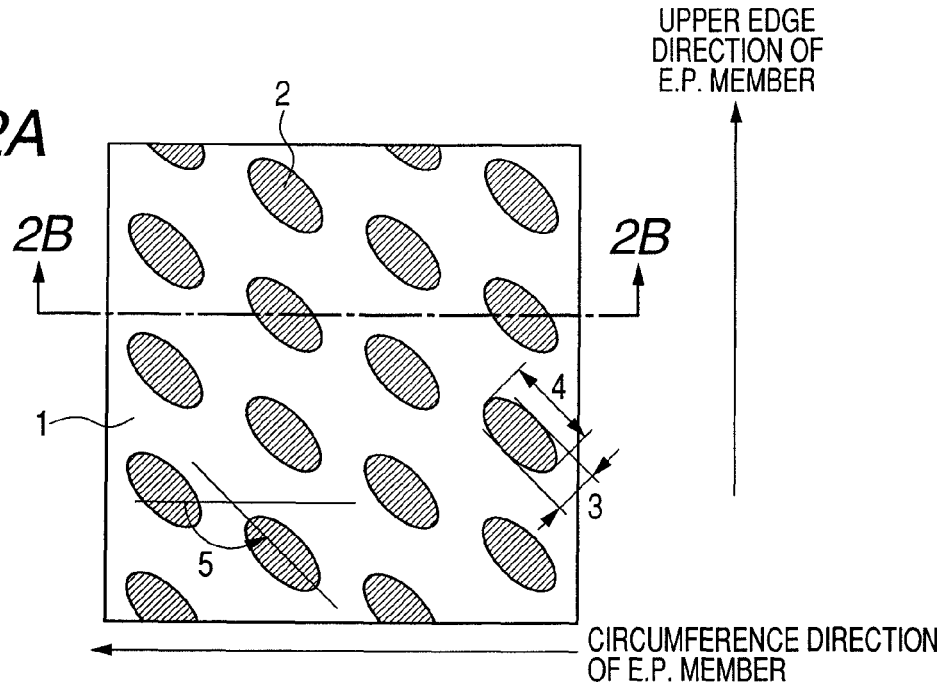
FIG. 2A is a view showing an example of a processed surface on the upper edge side of the electrophotographic photosensitive member.
Figure 2B:
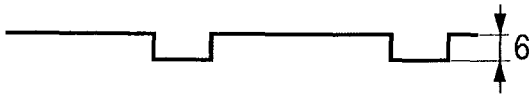
FIG. 2B is a sectional view taken along the line 2B-2B of FIG. 2A.
Figure 2C:
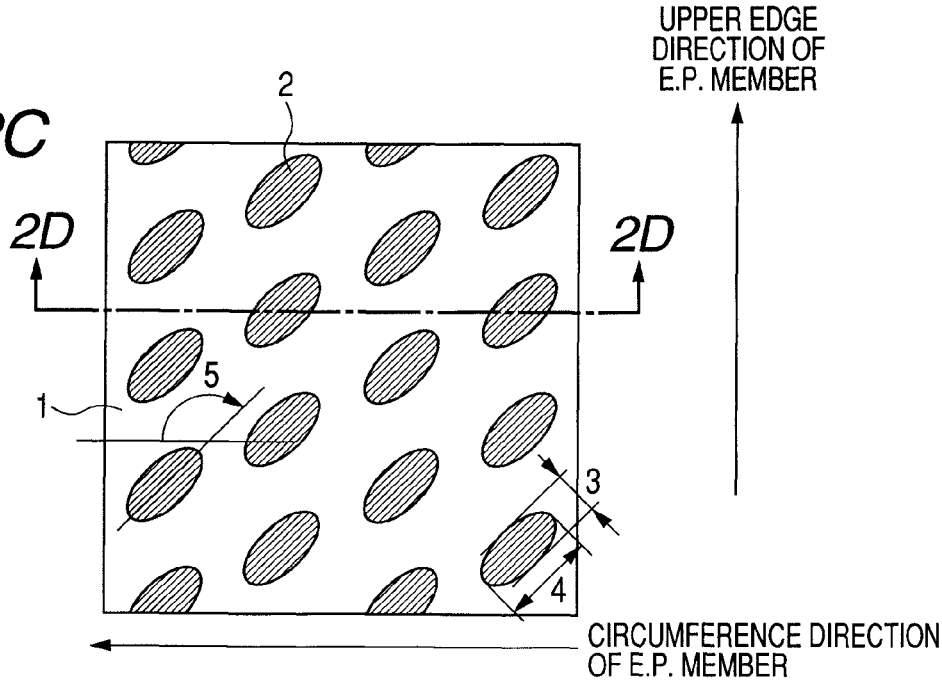
FIG. 2C is a view showing an example of a processed surface on the lower edge side of the electrophotographic photosensitive member.
Figure 2D:
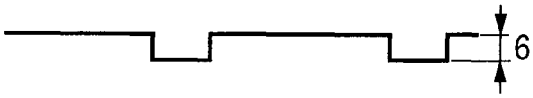
FIG. 2D is a sectional view taken along the line 2D-2D of FIG. 2C.
Figure 3A:
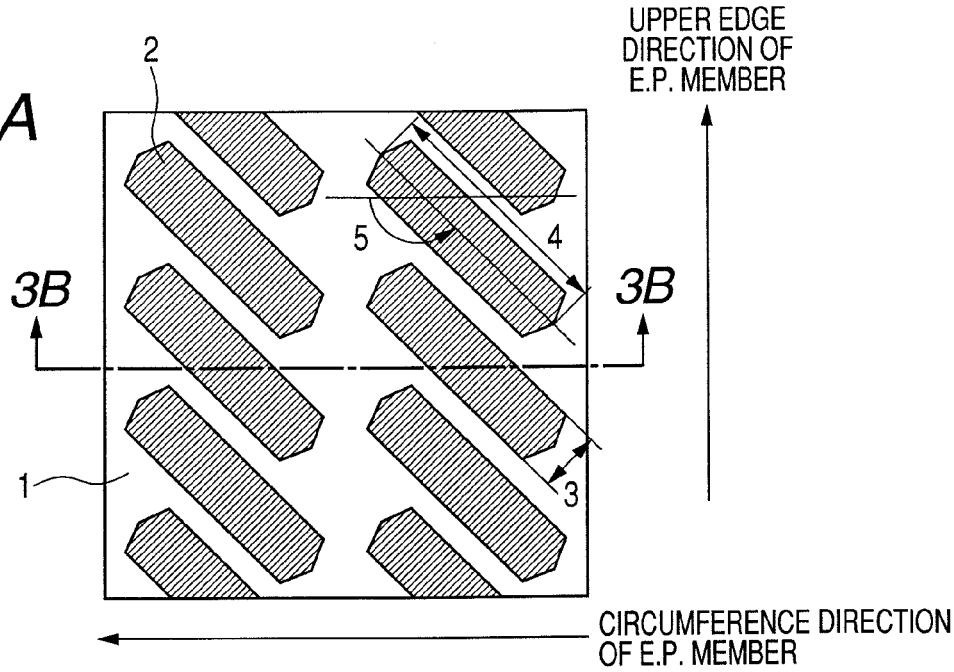
FIG. 3A is a view showing an example of the processed surface on the upper edge side of the electrophotographic photosensitive member.
Figure 3B:
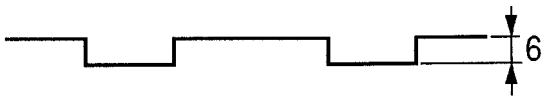
FIG. 3B is a sectional view taken along the line 3B-3B of FIG. 3A.
Figure 3C:
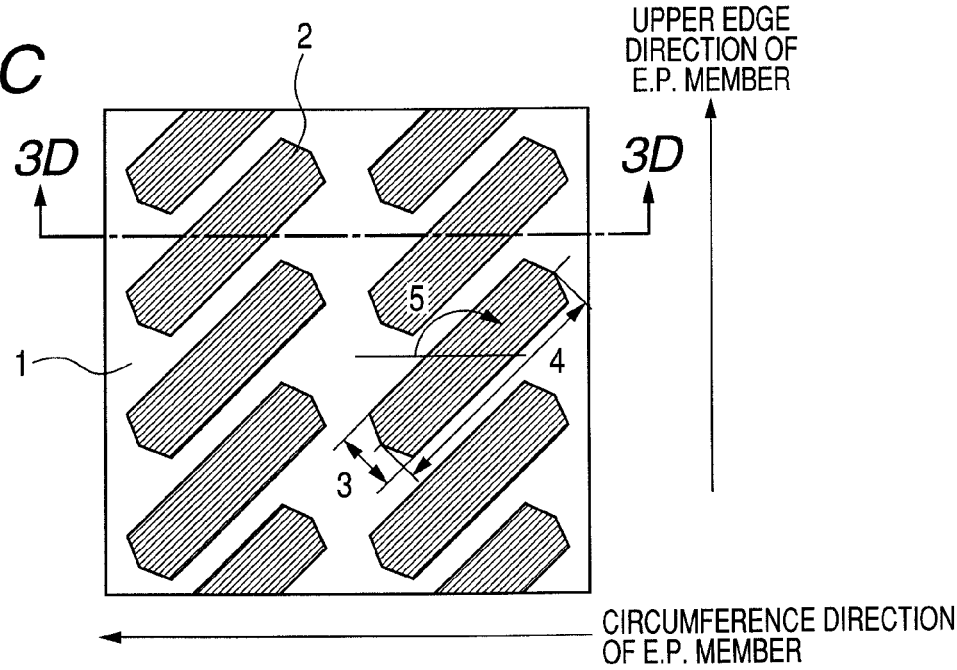
FIG. 3C is a view showing an example of the processed surface on the lower edge side of the electrophotographic photosensitive member.
Figure 3D:
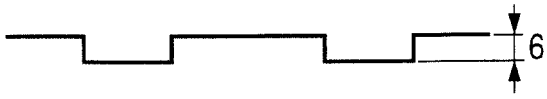
FIG. 3D is a sectional view taken along the line 3D-3D of FIG. 3C.
Figure 4A:
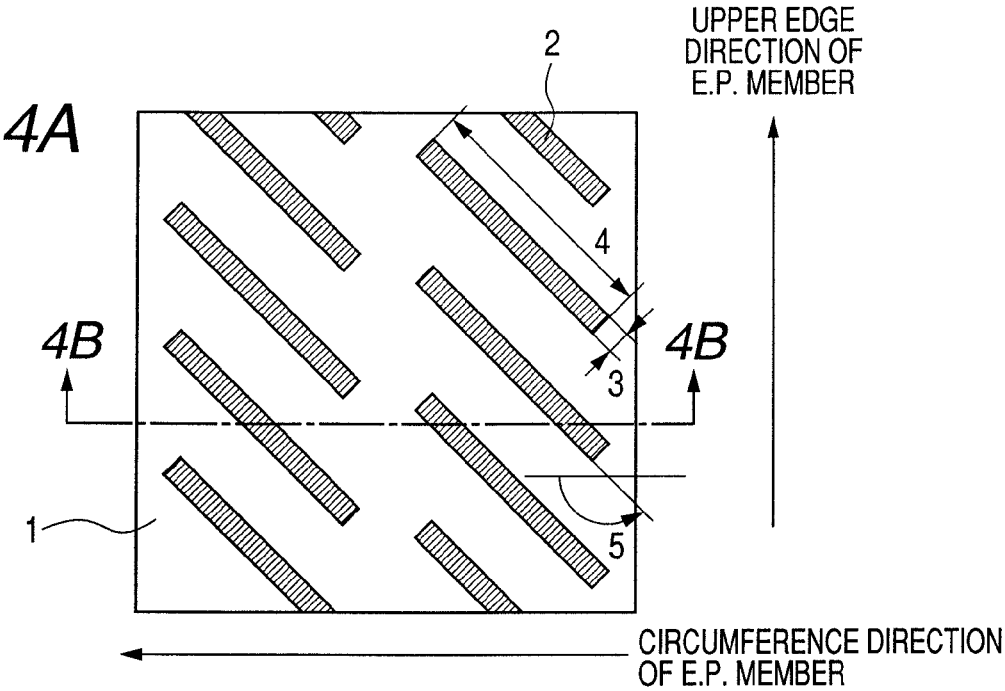
FIG. 4A is a view showing an example of the processed surface on the upper edge side of the electrophotographic photosensitive member.
Figure 4B:
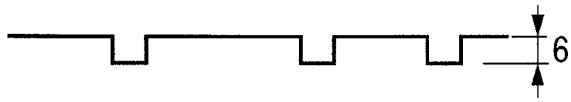
FIG. 4B is a sectional view taken along the line 4B-4B of FIG. 4A.
Figure 4C:
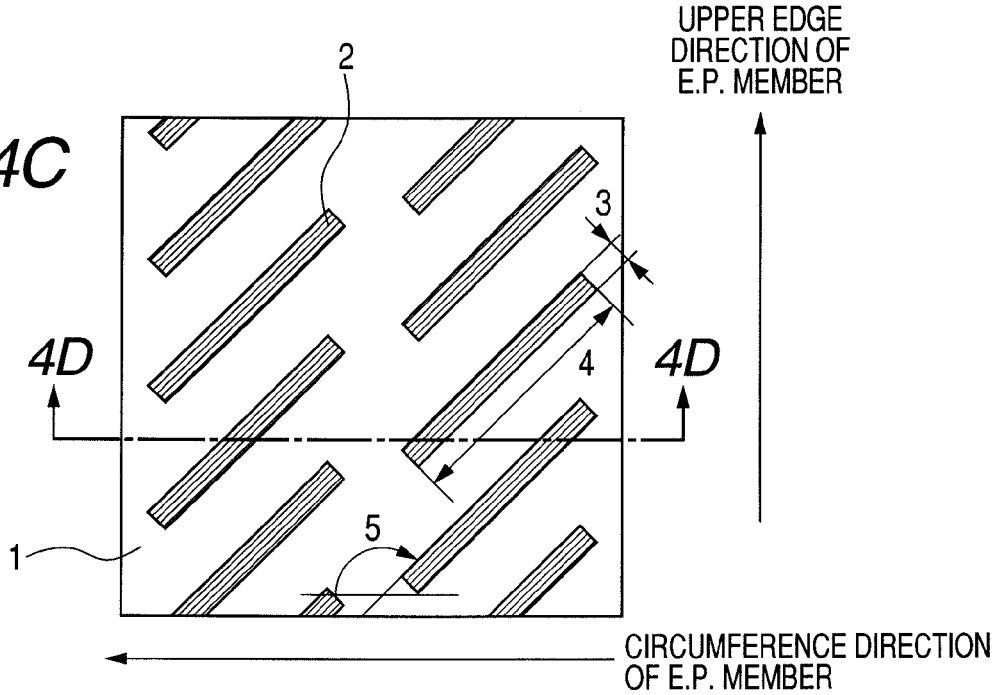
FIG. 4C is a view showing an example of the processed surface on the lower edge side of the electrophotographic photosensitive member.
Figure 4D:
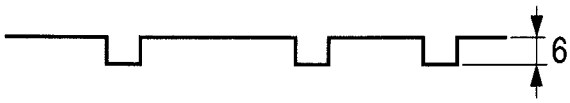
FIG. 4D is a sectional view taken along the line 4D-4D of FIG. 4C.
Figure 5A:
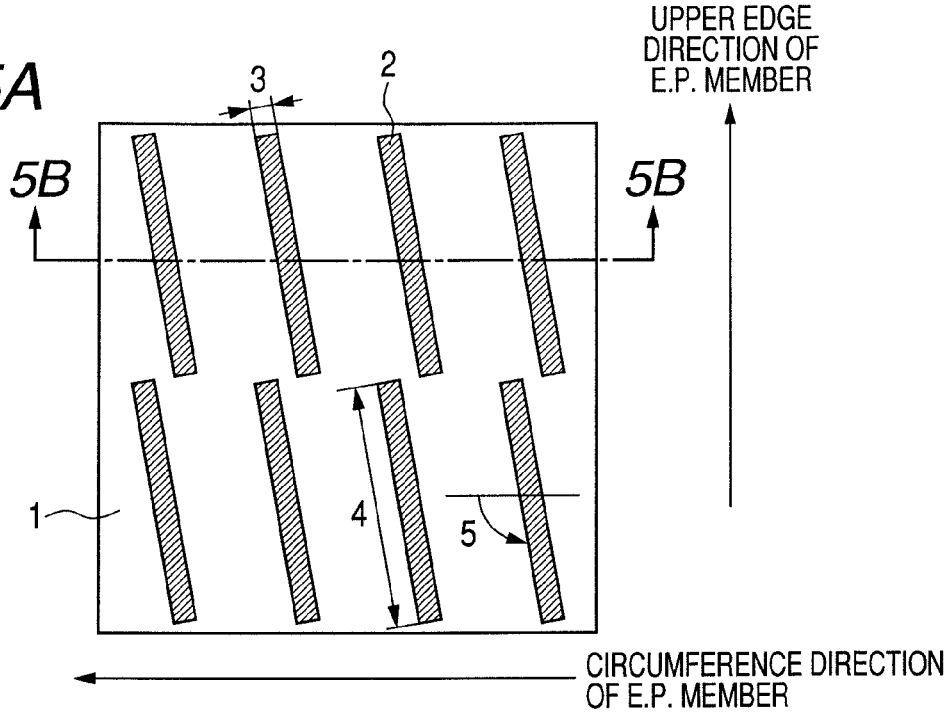
FIG. 5A is a view showing an example of the processed surface on the upper edge side of the electrophotographic photosensitive member.
Figure 5B:
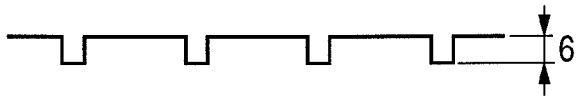
FIG. 5B is a sectional view taken along the line 5B-5B of FIG. 5A.
Figure 5C:
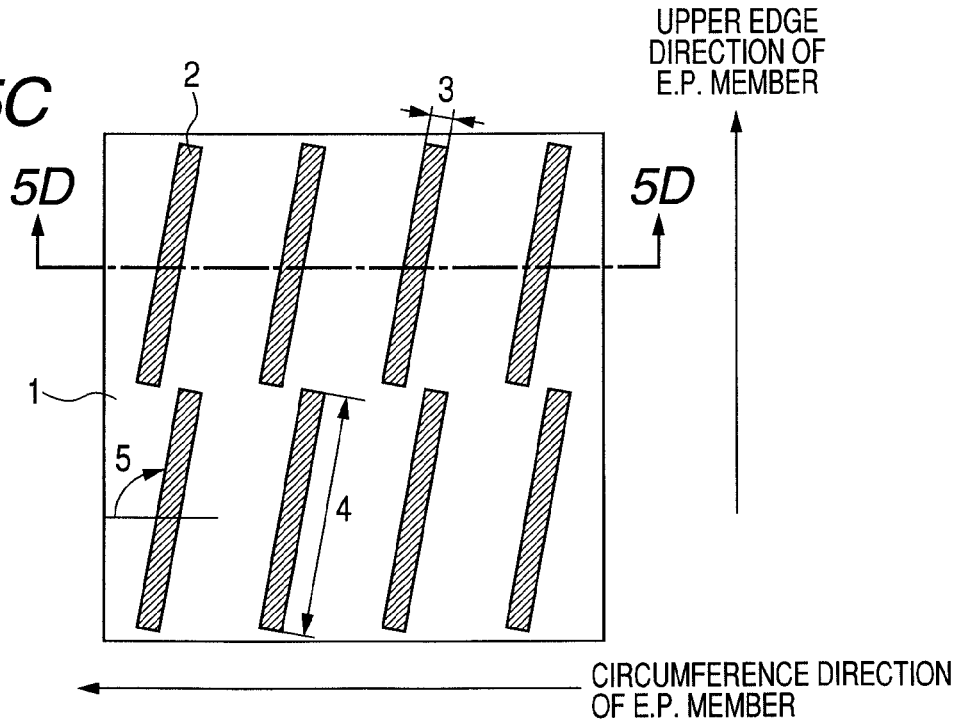
FIG. 5C is a view showing an example of the processed surface on the lower edge side of the electrophotographic photosensitive member.
Figure 5D:
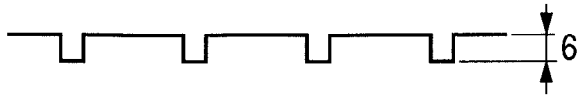
FIG. 5D is a sectional view taken along the line 5D-5D of FIG. 5C.
Figure 6A:
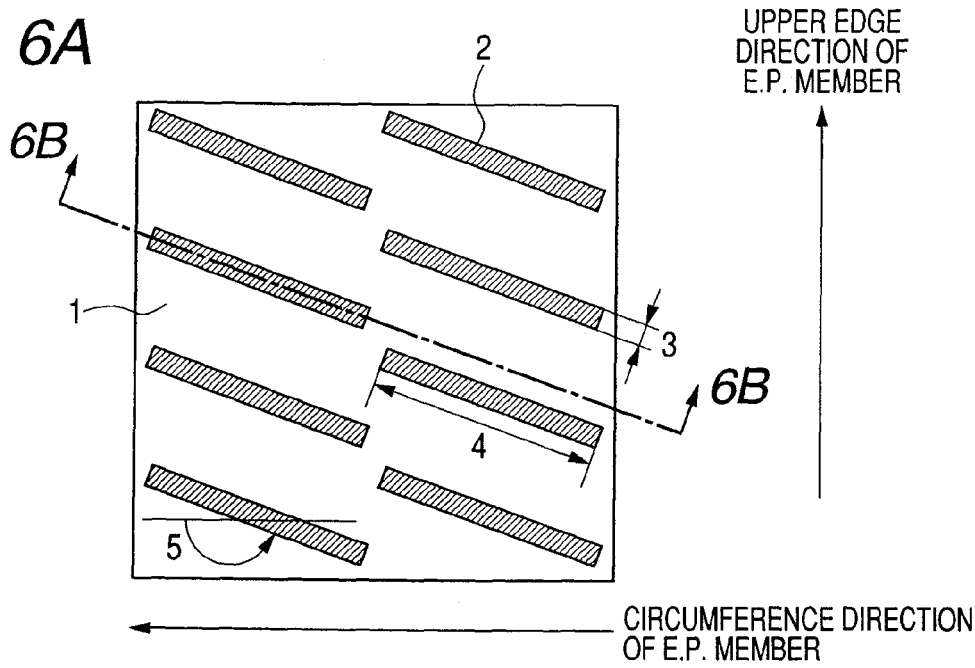
FIG. 6A is a view showing an example of the processed surface on the upper edge side of the electrophotographic photosensitive member.
Figure 6B:
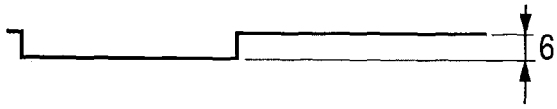
FIG. 6B is a sectional view taken along the line 6B-6B of FIG. 6A.
Figure 6C:
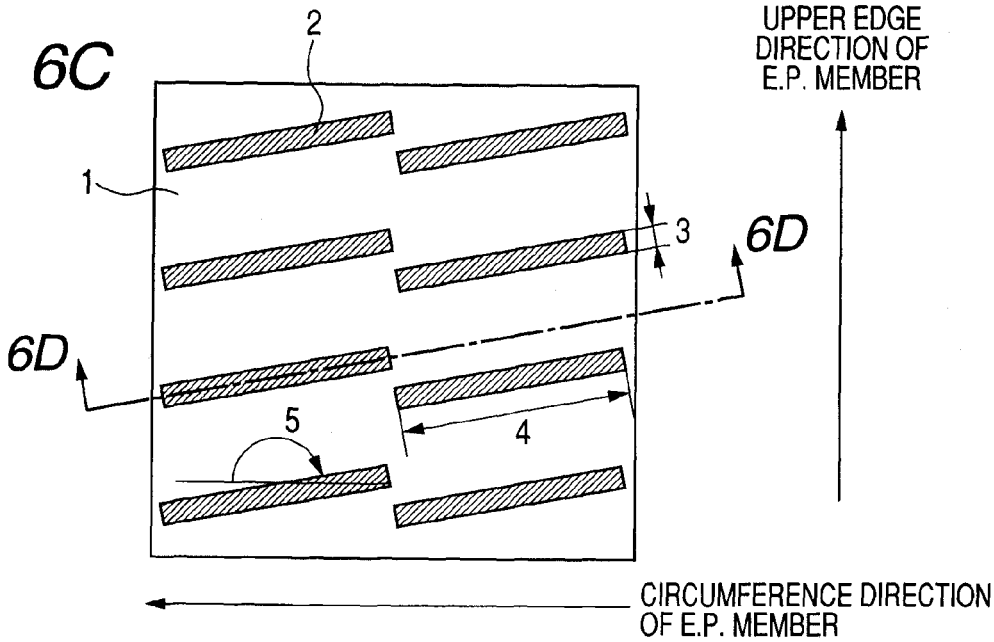
FIG. 6C is a view showing an example of the processed surface on the lower edge side of the electrophotographic photosensitive member.
Figure 6D:
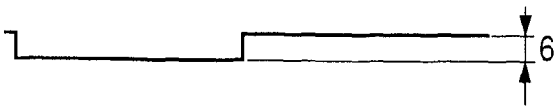
FIG. 6D is a sectional view taken along the line 6D-6D of FIG. 6C.
Figure 7A:
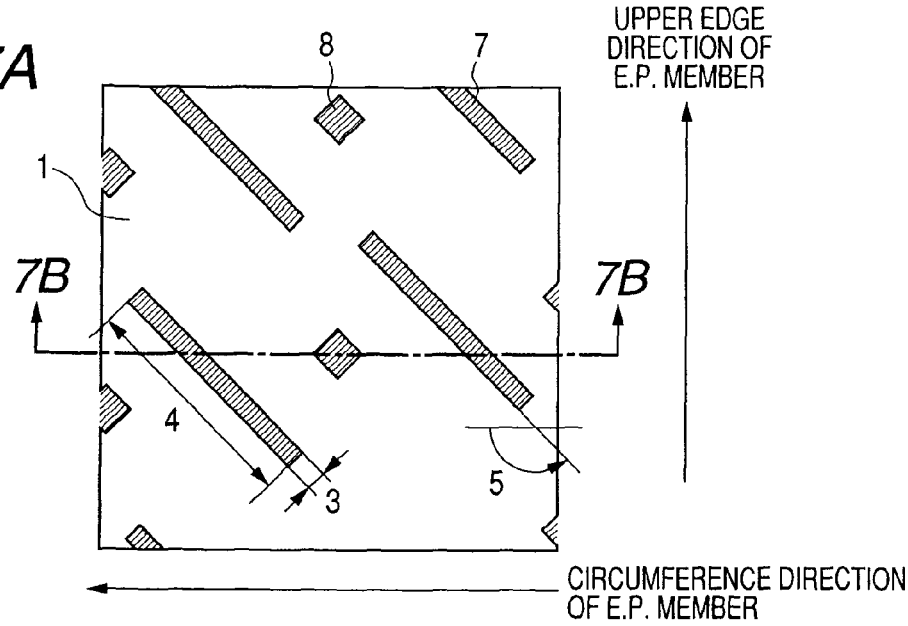
FIG. 7A is a view showing an example of the processed surface on the upper edge side of the electrophotographic photosensitive member.
Figure 7B:
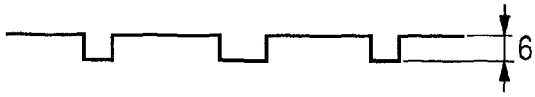
FIG. 7B is a sectional view taken along the line 7B-7B of FIG. 7A.
Figure 7C:
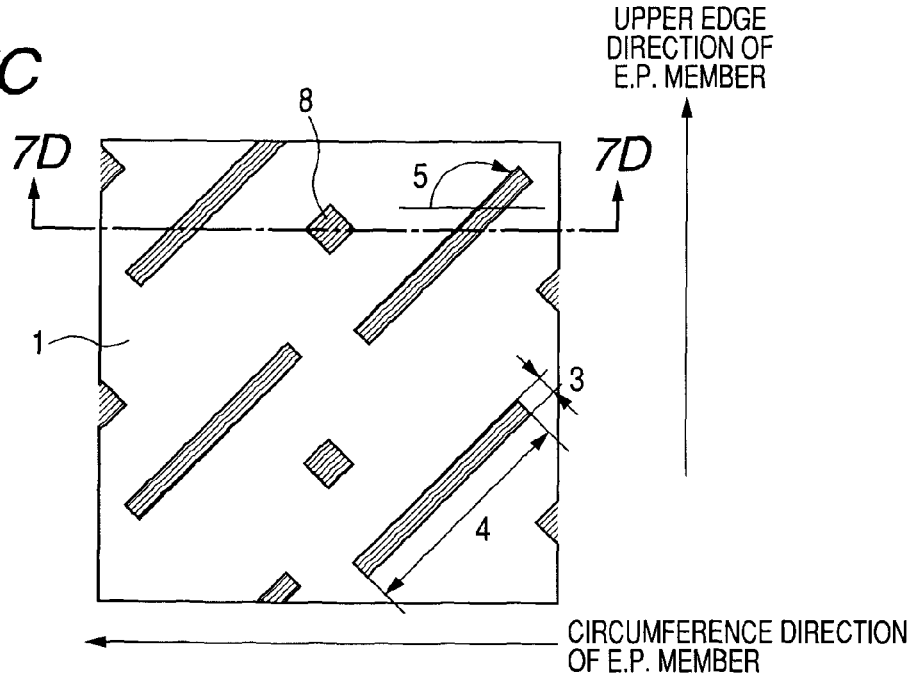
FIG. 7C is a view showing an example of the processed surface on the lower edge side of the electrophotographic photosensitive member.
Figure 7D:
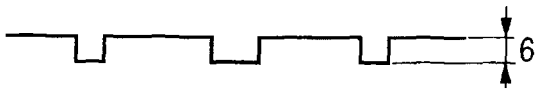
FIG. 7D is a sectional view taken along the line 7D-7D of FIG. 7C.
Figure 8A:
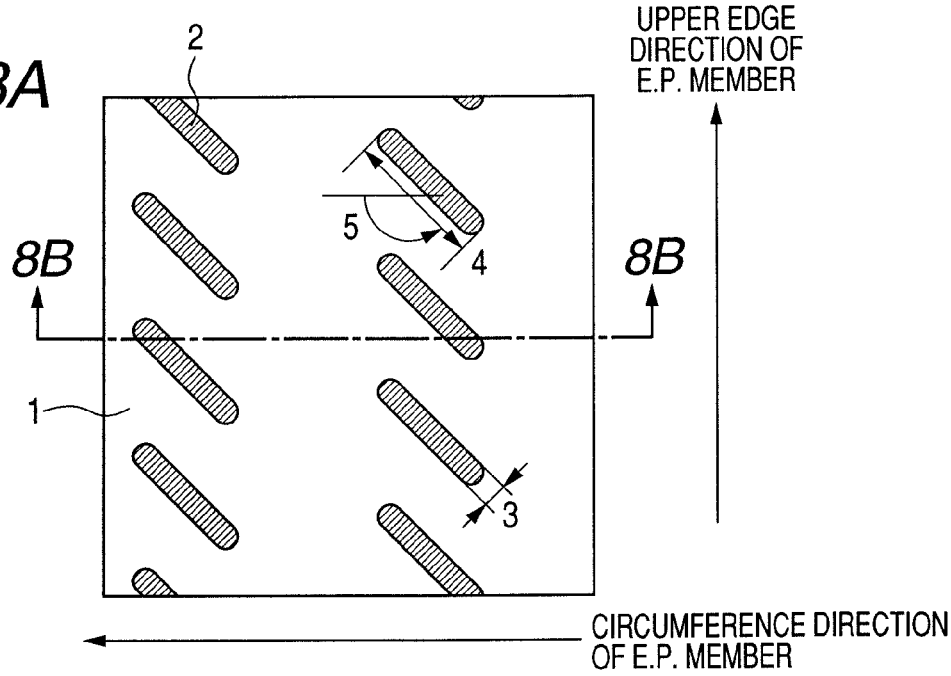
FIG. 8A is a view showing an example of the processed surface on the upper edge side of the electrophotographic photosensitive member.
Figure 8B:
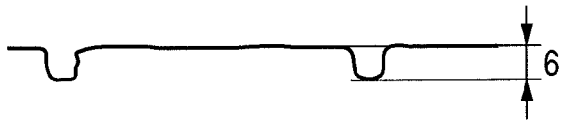
FIG. 8B is a sectional view taken along the line 8B-8B of FIG. 8A.
Figure 8C:
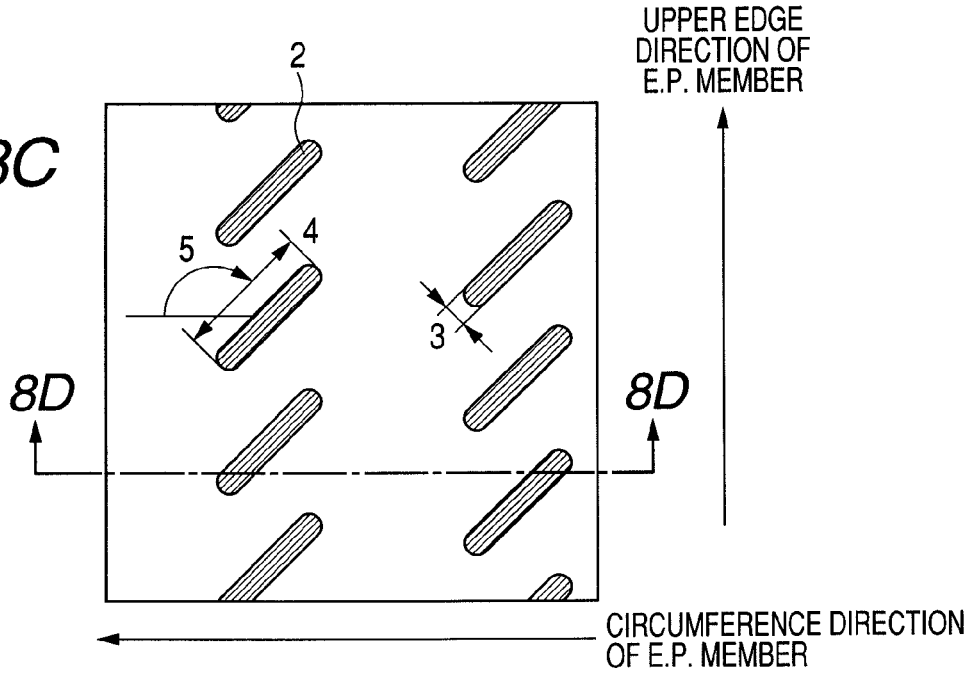
FIG. 8C is a view showing an example of the processed surface on the lower edge side of the electrophotographic photosensitive member.
Figure 8D:
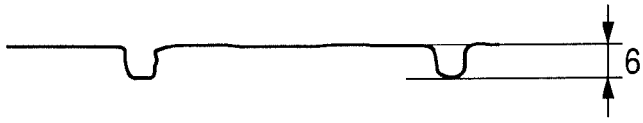
FIG. 8D is a sectional view taken along the line 8D-8D of FIG. 8C.

In addition, in the present invention, it is also preferable that the depressed portions are arranged so that another depressed portion is present on a line drawn from an edge portion in the direction of the long axis diameter Rpc of a certain depressed portion along the circumferential direction of the electrophotographic photosensitive member as indicated by a dotted line in FIG. 1D. The arrangement makes it possible to more effectively exert the actions of sweeping away the transfer residual toner toward the center of the electrophotographic photosensitive member and of scraping away the transfer residual toner from the electrophotographic photosensitive member at an edge portion of each depressed portion. Such a constitution results in the following. Even when transfer residual toner which has not been scraped away by the cleaning member toward a recovered toner container is present in an initial depressed portion, the transfer residual toner moves in the circumferential direction of the electrophotographic photosensitive member on the surface of the electrophotographic photosensitive member by virtue of the cleaning member so as to arrive at the next depressed portion. At the depressed portion, the transfer residual toner undergoes such an action as to sweep it away toward the center of the electrophotographic photosensitive member and such an action as to scrape it away from the surface of the electrophotographic photosensitive member at an edge portion of the depressed portion. Therefore, the effect of the present invention is additionally exerted.

In the present invention, there is no need to form the depressed portions in the entire region of the photosensitive member, and with regard to the circumferential direction of the photosensitive member, the depressed portions are preferably formed in a region corresponding to 50% or more of the peripheral length of the photosensitive member, more preferably in a region corresponding to 75% or more of the peripheral length, and still more preferably in the entire region in the circumferential direction of the photosensitive member.

FIGS. 2A to 8D show representative examples of the surface shape of the electrophotographic photosensitive member in the present invention. However, the present invention is not limited to these examples.

In addition, the depressed portions are preferably formed near a portion where a cleaning blade and a seal member closely contact with each other and from which recovered toner is apt to leak in order that the leakage of the recovered toner from an edge portion region of the electrophotographic photosensitive member can be effectively suppressed. That is, the formation of the depressed portions in both the edge portions in the longitudinal direction of the electrophotographic photosensitive member enhances the effect of sweeping away the transfer residual toner in the direction of moving away from the seal member (in other words, the direction toward the center portion of the image formation region). In addition, a higher effect can be expected when the depressed portions are formed near the seal member, that is, outside the largest region where a toner image is formed. Of course, the effect of the present invention can be obtained even when a region where depressed portions satisfying the requirements of the present invention are formed spreads into the center portion of the image formation region from an edge portion of an image formable region. For example, the surface of the electrophotographic photosensitive member is divided into two regions on the border passing through the center of the image formable region, and depressed portions satisfying the requirements of the present invention are formed in the entire surface of one region, and depressed portions having another shape and satisfying the requirements of the present invention are formed in the entire surface of the other region.

In addition, the depressed portions formed in both the edge portions of the electrophotographic photosensitive member do not need to be in similar shapes. That is, depressed portions completely different from depressed portions formed in one edge portion in shape, angle, arrangement, and density may be formed in the other edge portion as long as the requirements of the present invention are satisfied. In addition, the regions where the depressed portions are formed in both the edge portions may be different from each other in area or position.

Further, arbitrary depressed portions, projected portions or the like may be formed for another purpose in a region other than the regions where the depressed portions of the present invention are formed. For example, arbitrary depressed portions or projected portions different from the depressed portions which are formed in the edge portions of the electrophotographic photosensitive member and satisfy the requirements of the present invention may be formed in the image formable region. Alternatively, when each edge portion of the electrophotographic photosensitive member is provided with a region where the depressed portions of the present invention are formed, arbitrary depressed portions or projected portions can be formed in a region closer to the edge portion than the region. For example, assuming that depressed portions satisfying the requirements of the present invention are formed in the entire surface of a non-image formation region interposed between the edge portion of the image formable region and an edge portion on the side of the image formable region of a region contacting with the seal member abuts, the effect of the present invention can be obtained irrespective of whether or not arbitrary depressed portions or projected portions are formed in a region closer to the edge portion of the electrophotographic photosensitive member than the region where the depressed portions satisfying the requirements of the present invention are formed.

Next, a method of forming the surface shape of the electrophotographic photosensitive member of the present invention will be described.

The method of forming the surface shape of the present invention is not particularly limited as long as the above-mentioned requirements for the depressed portions can be satisfied, and for example, processing by unit of irradiation with excimer laser light may be cited.

The excimer laser light is radiated in the following process. First, high energy such as discharge, an electron beam, or an X ray is applied to a mixed gas containing a noble gas such as Ar, Kr or Xe and a halogen gas such as F or Cl so that the above-mentioned elements are bonded to each other by excitation. After that, excimer laser light is radiated upon dissociation of the elements due to the fall of each of the elements into its ground state.

Figure 9:
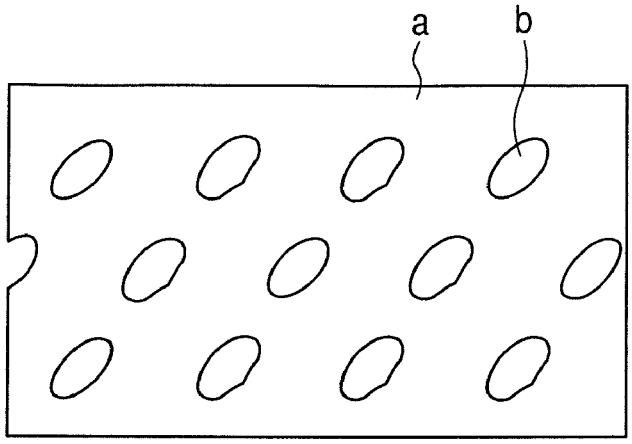
FIG. 9 is a view (partially enlarged view) showing an example of the array pattern of a mask.
Figure 10:
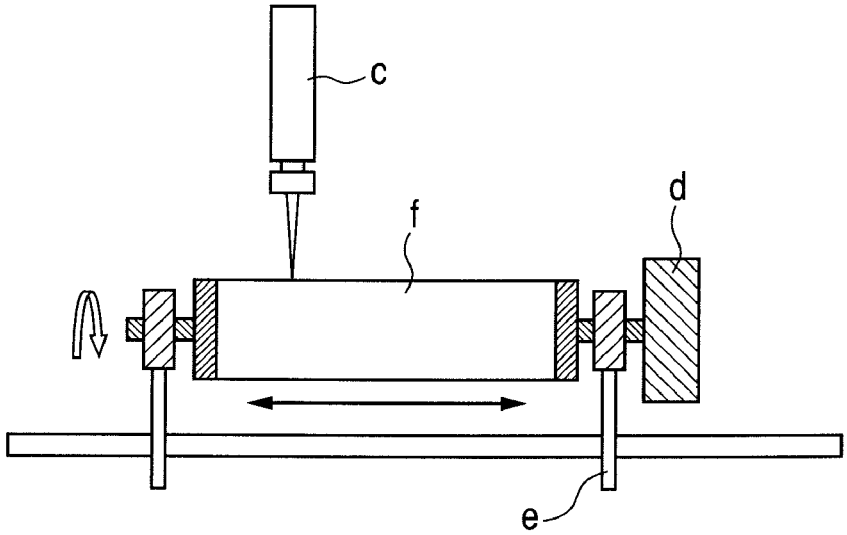
FIG. 10 is a view showing an example of the schematic view of a laser processing apparatus.

Examples of a gas to be used in the excimer laser light include ArF, KrF, XeCl, and XeF. Any one of the gases may be used, and KrF or ArF is particularly preferable. A method of forming depressed portions involves the use of such a mask as illustrated in FIG. 9 in which a laser light shielding portion a and a laser light transmitting portion b are appropriately arranged. Only laser light transmitted through the mask is converged with a lens and applied to a substance to be processed, whereby depressed portions having desired shapes and a desired arrangement can be formed. The foregoing process can be performed within a short time period because a large number of depressed portions in a certain area can be processed instantaneously and simultaneously irrespective of their shapes and areas. Several square millimeters to several square centimeters can be processed by applying laser light once while using the mask. In the laser processing, first, a substance to be processed is rotated on its axis by a motor d for work rotation as illustrated in FIG. 10. While the substance to be processed is rotated on its axis, the position to which laser light is applied is shifted in the axial direction of the substance to be processed by a work moving device e, whereby depressed portions can be efficiently formed in the entire region of the surface of the substance to be processed. The depth of depressed portions can be adjusted to fall within the desired range depending on, for example, the time period for which laser light is applied and the number of applications of laser light. Surface processing in which the sizes, shapes, and arrangement of depressed portions can be given with high controllability, high accuracy, and a high degree of freedom can be realized by the device.

In addition, the electrophotographic photosensitive member according to the present invention may be subjected to the above-mentioned processing by using the same mask pattern, thereby improving rough surface uniformity in the entirety of the surface of the electrophotographic photosensitive member.

In addition to the foregoing, as a method of forming the surface shape of the electrophotographic photosensitive member of the present invention, for example, a method may be cited involving bringing a mold having a predetermined shape into pressure contact with the surface of the electrophotographic photosensitive member to transfer the shape.

Figure 11:
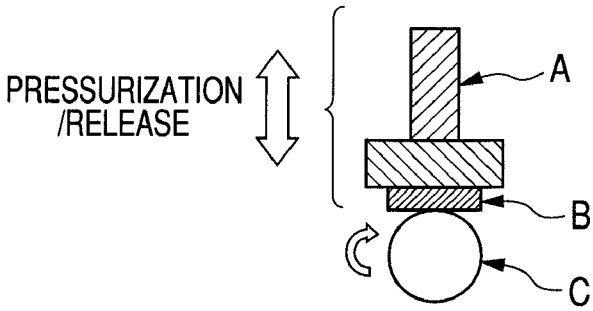
FIG. 11 is a view showing an example of the schematic view of a pressure contact profile transfer processing apparatus with a mold.

FIG. 11 illustrates a schematic view of a pressure contact shape transfer processing apparatus using a mold in the present invention. After a predetermined mold B is attached to a pressure device A capable of repeatedly performing pressurization and removal, the mold B is brought into contact with an electrophotographic photosensitive member C at a predetermined pressure so that the shape of the mold is transferred. Then, the pressure is temporarily removed, and the electrophotographic photosensitive member C is rotated. After that, a pressurizing step and a shape transferring step are performed again. Predetermined depressed shapes can be formed over the entire periphery of the electrophotographic photosensitive member by repeating the foregoing process.

Figure 12:
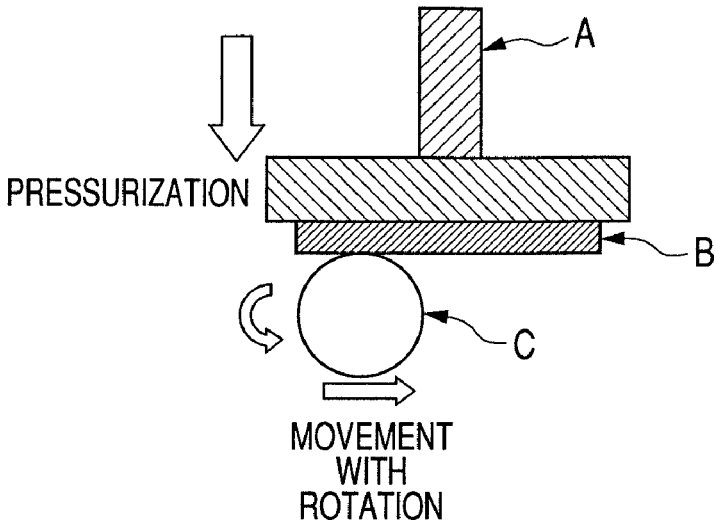
FIG. 12 is a view showing another example of the schematic view of the pressure contact profile transfer processing apparatus with a mold.
Figure 13A:
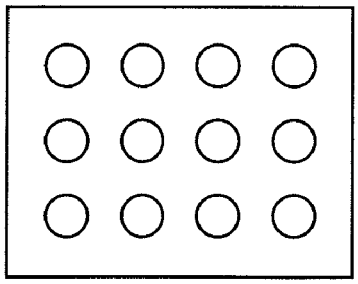
FIGS. 13A and 13B show an example of the shape of a mold, and are a plan view and a side view of the mold, respectively.
Figure 13C:
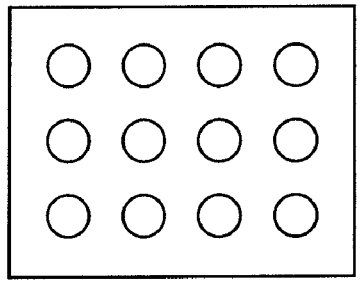
FIGS. 13C and 13D show an example of the shape of the mold, and are a plan view and a side view of the mold, respectively.
Figure 13B:
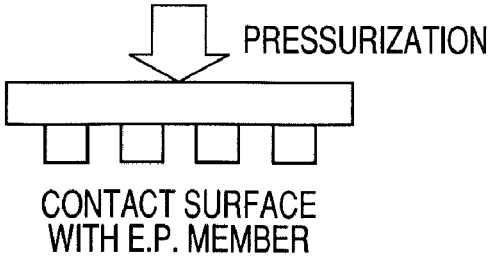
Figure 13D:
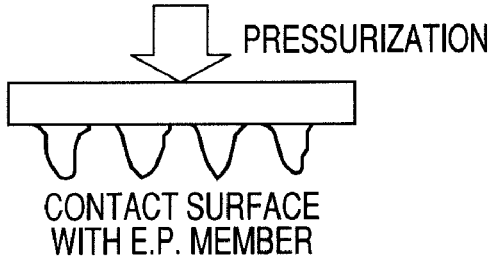

Alternatively, for example, predetermined depressed shapes can also be formed as illustrated in FIG. 12. First, the mold B longer than the entire peripheral length of the electrophotographic photosensitive member C is attached to the pressure device A. After that, the electrophotographic photosensitive member C is rotated and moved while a predetermined pressure is applied to the electrophotographic photosensitive member, whereby predetermined depressed shapes can be formed over the entire periphery of the electrophotographic photosensitive member.

Alternatively, the surface of an electrophotographic photosensitive member can be processed by: interposing a sheet-like mold between a roll-like pressure device and the electrophotographic photosensitive member; and feeding the mold sheet.

It should be noted that the mold or the electrophotographic photosensitive member may be heated in order that the shape of the mold may be efficiently transferred.

The material, size, and shape of a mold itself can be appropriately selected. Examples of the material include: a metal or a resin film subjected to fine surface processing; a material obtained by performing patterning onto the surface of a silicon wafer or the like with a resist; a resin film in which fine particles are dispersed; and a material obtained by coating a resin film having a predetermined fine surface shape with a metal. FIGS. 13A to 13D each illustrate an example of a mold shape.

In addition, an elastic body can be placed between the mold and the pressure device with the view of bringing the mold into contact with the electrophotographic photosensitive member with a uniform pressure.

Next, a method of measuring the surface shape of the electrophotographic photosensitive member of the present invention will be described.

The depressed portions in the surface of the electrophotographic photosensitive member according to the present invention can be measured with a commercially available laser microscope, and for example, the following instruments and analysis programs attached thereto can be utilized. An ultradeep shape measuring microscope VK-8500, and VK-8700 (each of which is manufactured by KEYENCE CORPORATION); a surface shape measuring system SURFACE EXPLORER SX-520 DR (manufactured by Ryoka Systems Inc); a scanning confocal laser microscope OLS 3000 (manufactured by OLYMPUS CORPORATION); and a real color confocal microscope OPTELICS C130 (manufactured by Lasertec Corporation).

The number of depressed portions, and the short axis diameter Lpc, long axis diameter Rpc and depth Rdv of each of the depressed portions in a certain field of view can be measured with the above-mentioned laser microscope at a predetermined magnification. Further, the average short axis diameter Lpc-A, the average long axis diameter Rpc-A, the average depth Rdv-A, and area ratio of the depressed portions per unit area can be calculated. It should be noted that measurement and observation can be performed with, for example, an optical microscope, an electron microscope, an atomic force microscope, or a scanning probe microscope.

Measurement involving the utilization of an analysis program according to a Surface Explorer SX-520 DR type will be described as an example. First, a sample to be measured is placed on a work placement table and subjected to tilt adjustment so as to be horizontal, and three-dimensional shape data on the peripheral surface of the electrophotographic photosensitive member is taken in according to a wave mode. At that time, a field of view measuring 100 μm by 100 μm (10,000 $\mu m^2$) may be observed with an objective lens at a magnification of 50. The measurement is performed by the method for a square region 100 μm in side provided for inside the region where the depressed portions are formed in the surface of the sample to be measured. The measurement is performed in a square region 100 μm in side provided for inside each of ten regions obtained by dividing the region where the depressed portions are formed in the surface of the sample into ten identical portions in the direction parallel to an arbitrary direction of the sample. For example, in the case of a sample in which depressed portions are formed in the surface of a cylindrical electrophotographic photosensitive member, the measurement is performed in a square region 100 μm in side having a side parallel to the circumferential direction of the electrophotographic photosensitive member and provided for inside each of ten regions obtained by dividing a region where the depressed portions are formed into ten identical portions in the circumferential direction.

Next, contour line data on the surface of the electrophotographic photosensitive member is displayed by using a particle analysis program in data analysis software. Each of the pore analysis parameters for determining the shape and area or the like of the depressed portion can be optimized in accordance with the formed depressed form. However, for example, when depressed forms each having the longest long axis diameter of about 10 μm are observed and measured, the upper limit of the longest long axis diameter, the lower limit of the longest long axis diameter, the lower limit of a depth, and the lower limit of a volume may be set to 15 μm, 1 μm, 0.1 μm, and 1 $\mu m^3$ or more, respectively. In this way, the number of depressed forms that can be judged to be depressed portions on a screen to be analyzed is counted, and the counted number is defined as the number of depressed portions.

Next, the constitution of an electrophotographic photosensitive member of the present invention will be described.

The electrophotographic photosensitive member of the present invention has a support and an organic photosensitive layer (hereinafter simply referred to also as "photosensitive layer") provided on the support. Although, in general, a cylindrical organic electrophotographic photosensitive member obtained by forming a photosensitive layer on a cylindrical support is widely used, the electrophotographic photosensitive member according to the present invention may be in a belt-like shape or a sheet-like shape.

The photosensitive layer may be of a single-layered type containing a charge transport material and a charge generation material in the same layer or of a lamination type (function-separated type) having separately a charge generating layer containing a charge generation material and a charge transporting layer containing a charge transport material. For an electrophotographic photosensitive member according to the present invention, the lamination type photosensitive layer is preferred in view of electrophotographic characteristics. Further, the lamination type photosensitive layer may be an order type photosensitive layer having a charge generating layer and a charge transporting layer in this order stacked on a support or a reverse type photosensitive layer having a charge transporting layer and a charge generating layer in this order stacked on a support. When the lamination type photosensitive layer is adopted in the electrophotographic photosensitive member according to the present invention, the charge generating layer may be in a laminated structure, or the charge transporting layer may be in a laminated structure. Further, a protective layer can be provided on the photosensitive layer for improving the durability of the electrophotographic photosensitive member.

A material for the support has only to show conductivity (conductive support). For example, the following may be cited: a support made of a metal (alloy) such as iron, copper, gold, silver, aluminum, zinc, titanium, lead, nickel, tin, antimony, indium, chromium, an aluminum alloy, or stainless steel. The above-mentioned metal support or a plastic support having a layer coated with a film formed by depositing aluminum, an aluminum alloy, or an indium oxide-tin oxide alloy, may also be used. A support obtained by impregnating a plastic or paper with conductive particles such as carbon black, tin oxide particles, titanium oxide particles, or silver particles together with a suitable binder resin, or a plastic support having a conductive binder resin may also be used.

The surface of the support may be subjected to cutting, surface-roughening treatment, or alumite treatment for preventing an interference fringe due to scattering of laser light.

A conductive layer may be provided between the support and an intermediate layer to be described later or the photosensitive layer (including the charge generating layer and the charge transporting layer) for preventing an interference fringe due to the scattering of laser light or for covering a flaw on the support.

The conductive layer may be formed by using a coating liquid for a conductive layer prepared by dispersing and/or dissolving carbon black, a conductive pigment, or a resistance adjusting pigment in a binder resin. A compound that undergoes curing polymerization by heating or irradiation with radiation may be added to the coating liquid for a conductive layer. The surface of a conductive layer in which a conductive pigment or a resistance adjusting pigment is dispersed tends to be roughened.

The conductive layer has a thickness of preferably 0.2 μm or more and 40 μm or less, more preferably 1 μm or more to 35 μm or less, or still more preferably 5 μm or more to 30 μm or less.

Examples of the binder resin to be used in the conductive layer include polymers and copolymers of vinyl compounds such as styrene, vinyl acetate, vinyl chloride, acrylate, methacrylate, vinylidene fluoride, and trifluoroethylene. They also include polyvinyl alcohol, polyvinyl acetal, polycarbonate, polyester, polysulfone, polyphenylene oxide, polyurethane, a cellulose resin, a phenol resin, a melamine resin, a silicone resin, and an epoxy resin.

Examples of the conductive pigment and the resistance adjusting pigment include: particles of metals (alloys) such as aluminum, zinc, copper, chromium, nickel, silver, and stainless steel; and materials obtained by depositing these metals on the surfaces of plastic particles. Particles of metal oxides such as zinc oxide, titanium oxide, tin oxide, antimony oxide, indium oxide, bismuth oxide, indium oxide doped with tin, and tin oxide doped with antimony or tantalum are also included. One type of these types of particles may be used singly, or two or more types of them may be used in combination. When two or more types of particles are used in combination, they may be merely mixed, or may be in the form of a solid solution or fusing.

An intermediate layer having a barrier function or an adhesion function may be provided between the support and the conductive layer or the photosensitive layer (including the charge generating layer and the charge transporting layer). The intermediate layer is formed for: improving the adhesiveness and coating properties of the photosensitive layer; improving charge injection properties from the support; and protecting the photosensitive layer against electrical breakage.

Examples of a material for the intermediate layer include polyvinyl alcohol, poly-N-vinylimidazole, polyethylene oxide, and ethylcellulose. They also include an ethylene-acrylic acid copolymer, casein, polyamide, N-methoxymethylated 6 nylon, copolymerized nylon, glue, and gelatin. The intermediate layer can be formed by: applying an application liquid for an intermediate layer prepared by dissolving any one of those materials in a solvent; and drying the applied liquid.

The intermediate layer has a thickness of preferably 0.05 μm or more and 7 μm or less, or more preferably 0.1 μm or more and 2 μm or less.

Next, a photosensitive layer of the present invention will be described below in more detail.

Examples of the charge generating substance to be used in the photosensitive layer in the present invention include: selenium-tellurium; pyrylium; thiapyrylium-type dyes; and phthalocyanine pigments having various central metals and various crystal systems (such as α, β, γ, ϵ, and X types). They also include: anthanthrone pigments; dibenzpyrenequinone pigments; pyranthrone pigments; azo pigments such as monoazo, disazo, and trisazo pigments; indigo pigments; quinacridone pigments; asymmetric quinocyanine pigments; and quinocyanine pigments. Further, amorphous silicon is also permitted. One type of these types of charge generating substances may be used alone, or two or more types of them may be used.

Examples of the charge transporting substance to be used in the electrophotographic photosensitive member of the present invention include: pyrene compounds; N-alkylcarbazole compounds; hydrazone compounds; N,N-dialkylaniline compounds; diphenylamine compounds; and triphenylamine compounds. They also include: triphenylmethane compounds; pyrazoline compounds; styryl compounds; and stilbene compounds.

In a case where the photosensitive layer is functionally separated into a charge generating layer and a charge transporting layer, the charge generating layer can be formed by the following method. First, the charge generation material is dispersed with a binder resin 0.3 to 4 times as much as the mass of the charge generation material and a solvent by unit of a homogenizer, an ultrasonic disperser, a ball mill, a vibrating ball mill, a sand mill, an attritor, or a roll mill. A coating liquid prepared through the dispersion for a charge generating layer is applied. The applied liquid is dried, whereby the charge generating layer can be formed. Alternatively, the charge generating layer may be a deposition film of the charge generating substance.

The charge transporting layer can be formed by: applying a coating liquid for a charge transporting layer prepared by dissolving a charge transporting substance and a binder resin in a solvent; and drying the applied liquid. Alternatively, among the above-mentioned charge transporting substances, a substance having film forming ability by itself can be formed into the charge transporting layer without using a binder resin.

Examples of the binder resin to be used in each of the charge generating layer and the charge transporting layer include polymers and copolymers of vinyl compounds such as styrene, vinyl acetate, vinyl chloride, an acrylate, a methacrylate, vinylidene fluoride, and trifluoroethylene. They also include polyvinyl alcohol, polyvinyl acetal, polycarbonate, polyester, polysulfone, polyphenylene oxide, polyurethane, a cellulose resin, a phenol resin, a melamine resin, a silicone resin, and an epoxy resin.

The charge generating layer has a thickness of preferably 5 μm or less, or more preferably 0.1 μm or more and 2 μm or less. The charge transporting layer has a thickness of preferably 5 μm or more and 50 μm or less, or more preferably 10 μm or more and 35 μm or less.

As described above, when improving durability as one of the characteristics required for the electrophotographic photosensitive member, in the case of the above-mentioned function-separated type photosensitive layer, the design of a material for the charge transporting layer as a surface layer is important. Examples of the design include: the use of a binder resin having a high strength; the control of a ratio between a charge transporting substance showing plasticity and a binder resin; and the use of a polymeric charge transporting substance. Forming the surface layer from a curable resin is effective for the expression of higher durability.

In the present invention, the charge transporting layer itself can be formed from a curable resin. In addition, a curable resin layer as a second charge transporting layer or as a protective layer can be formed on the above-mentioned charge transporting layer. Compatibility between film strength and charge transporting ability is a characteristic required for the curable resin layer, and hence the layer is generally formed from a charge transporting material and a polymerizable or crosslinkable monomer or oligomer.

Any one of the known hole transportable compounds and electron transportable compounds can be used as the charge transporting material. Examples of the polymerizable or crosslinkable monomer or oligomer include: a chain polymerization type material having an acryloyloxy group or a styrene group; and a successive polymerization type material having a hydroxyl group, an alkoxysilyl group, or an isocyanate group. From the viewpoints of an electrophotographic characteristic to be obtained, general-purpose property, material design, and production stability, a combination of a hole transportable compound and a chain polymerization type material is preferable, and furthermore, a system for curing a compound having both a hole transportable group and an acryloyloxy group in its molecule is particularly preferable. Any known unit such as heat, light, or radiation can be utilized as curing unit.

The curable resin layer has a thickness of preferably 5 μm or more and 50 μm or less, or more preferably 10 μm or more and 35 μm or less when the layer is the charge transporting layer as in the case of the foregoing. The layer has a thickness of preferably 0.1 μm or more and 20 μm or less, or more preferably 1 μm or more and 10 μm or less when the layer is the second charge transporting layer or the protective layer.

In the present invention, desired depressed portions can be formed by subjecting an electrophotographic photosensitive member having a surface layer produced by the above-mentioned method to the above-mentioned laser processing or the above-mentioned pressure contact profile transfer processing using a mold.

As described above, the electrophotographic photosensitive member according to the present invention has specific depressed portions in its surface. The depressed portions according to the present invention act most effectively and persistently when being applied to an electrophotographic photosensitive member the surface of which is difficult to wear.

The electrophotographic photosensitive member the surface of which is difficult to wear according to the present invention is such that the surface has an elastic deformation rate of preferably 40% or more, more preferably 45% or more, or still more preferably 50% or more.

In addition, the surface of the electrophotographic photosensitive member according to the present invention has a universal hardness value (HU) of preferably 150 $N/mm^2$ or more. The elastic deformation rate of less than 40%, or the universal hardness value of less than 150 $N/mm^2$ is not preferred because the surface is liable to wear.

As described above, the electrophotographic photosensitive member the surface of which is difficult to wear shows an extremely small, or no, change in the above-mentioned fine surface shape even after being repeatedly used as compared with that in the initial state of the member, and so, can maintain its initial performance favorably even when being repeatedly used for a long time period. The universal hardness value (HU) and elastic deformation rate of the surface of the electrophotographic photosensitive member can be measured with a microhardness measuring device FISCHERSCOPE H100V (manufactured by Fischer Technology, Inc.) in an environment having a temperature of 25° C. and a humidity of 50% RH.

Various additives can be added to each layer of the electrophotographic photosensitive member of the present invention. Examples of the additives include: an anti-degradation agent such as an antioxidant and a UV absorber; and lubricants such as fluorine atom-containing resin particles.

Next, toner to be used in the present invention will be described.

A method of producing the toner to be used in combination with the electrophotographic photosensitive member of the present invention is not particularly limited, and the toner is preferably produced by, for example, a suspension polymerization method, a mechanical pulverization method, or a sphericity treatment, or is particularly preferably produced by the suspension polymerization method. Toner particles produced by the method as described above can be used as they are, but may be used after having been mixed with one or multiple types of inorganic particles or organic resin particles selected as external additives as required.

The average particle diameter of the toner can be suitably measured by a pore electrical resistance method. Description will be given below by taking as an example a case where a COULTER MULTISIZER II (manufactured by Beckman Coulter, Inc) is used as a measuring device.

A 1% aqueous solution of NaCl prepared by using first class grade sodium chloride has only to be used as an electrolyte solution for measurement; for example, an ISOTON R-II (manufactured by Coulter Scientific Japan, Co.) can be used. A measurement method is as described below. First, 0.3 ml of a surfactant, or preferably an alkylbenzene sulfonate, is added as a dispersant to 100 to 150 ml of the electrolyte solution. Further, 2 to 20 mg of a measurement sample are added to the mixture. The electrolyte solution in which the sample has been suspended is subjected to dispersion treatment with an ultrasonic dispersing unit for about 1 to 3 minutes. The volumes and number of the particles of the toner are measured with the measuring device, and the volume distribution and number distribution of the toner are calculated. Then, the weight average particle diameter (D4) (the central value of each channel is regarded as a representative value for the channel) of the toner is determined. When the weight average particle diameter is larger than 6.0 μm, the volumes and number of particles each having a particle diameter of 2 to 60 μm are measured with a 100 μm aperture. When the weight average particle diameter is 3.0 to 6.0 μm, the volumes and number of particles each having a particle diameter of 1 to 30 μm are measured with a 50 μm aperture. When the weight average particle diameter is less than 3.0 μm, the volumes and number of particles each having a particle diameter of 0.6 to 18 μm are measured with a 30 μm aperture.

Next, a process cartridge and an electrophotographic apparatus of the present invention will be described.

Figure 14A:
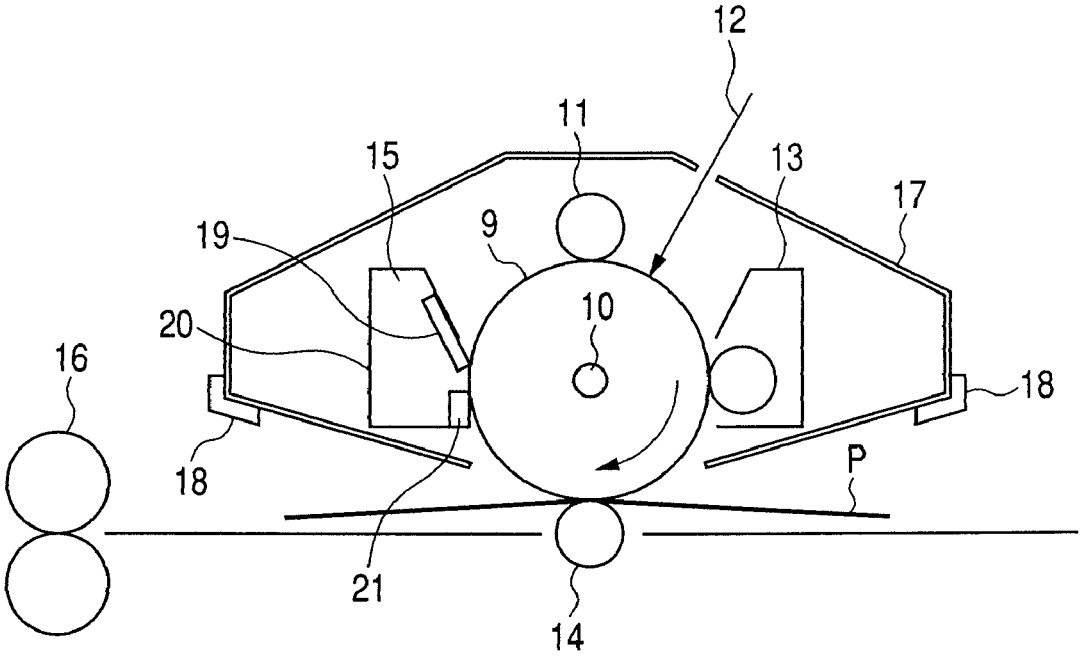
FIG. 14A is a view showing an example of the schematic constitution of an electrophotographic apparatus provided with a process cartridge having the electrophotographic photosensitive member of the present invention.

FIG. 14A is a view illustrating an example of the schematic constitution of an electrophotographic apparatus provided with a process cartridge having the electrophotographic photosensitive member of the present invention. In FIG. 14A, reference numeral 9 is a cylindrical electrophotographic photosensitive member, which is rotated on an axis 10 in the direction indicated by an arrow at a predetermined circumferential speed. The peripheral surface of the electrophotographic photosensitive member 9 to be rotated is uniformly charged to a predetermined, positive or negative potential by a charging unit (primary charging unit: a charging roller or the like) 11. Next, the peripheral surface receives exposure light (image exposure light) 12 output from an exposing unit (not shown) such as slit exposure or laser beam scanning exposure. Thus, electrostatic latent images corresponding to an objective image are sequentially formed on the peripheral surface of the electrophotographic photosensitive member 9. The charging unit 11 is not limited to such a contact charging unit using a charging roller as illustrated in FIG. 14A, and may be a corona charging unit using a corona charger, or charging unit according to any other systems.

The electrostatic latent images formed on the peripheral surface of the electrophotographic photosensitive member 9 are developed with toner contained in the developer in a developing unit 13 into toner images. Next, the toner images formed and carried on the peripheral surface of the electrophotographic photosensitive member 9 are sequentially transferred onto a transfer material (such as paper) P by a transferring bias from a transferring unit (such as a transferring roller) 14. The transfer material P may be fed from a transfer material feeding unit (not shown) into a portion between the electrophotographic photosensitive member 9 and the transferring unit 14 (contact portion) in synchronization with the rotation of the electrophotographic photosensitive member 9. In addition, a system is available in which a toner image is temporarily transferred onto an intermediate transfer material or an intermediate transfer belt instead of a transfer material, and is then transferred onto the transfer material (such as paper).

The transfer material P onto which the toner images have been transferred is separated from the peripheral surface of the electrophotographic photosensitive member 9 and introduced into a fixing unit 16 where the images are fixed. As a result, the material is printed out as an image formed article (print or copy) to the outside of the apparatus.

Transfer residual toner on the peripheral surface of the electrophotographic photosensitive member 9 after the transfer of the toner images is removed by a cleaning unit (such as an elastic member, in this figure, a cleaning blade 19) 15 so that the peripheral surface is cleaned. Further, the peripheral surface is subjected to de-charging with pre-exposure light (not shown) from a pre-exposing unit (not shown), and is then repeatedly used in image formation.

Figure 14B:
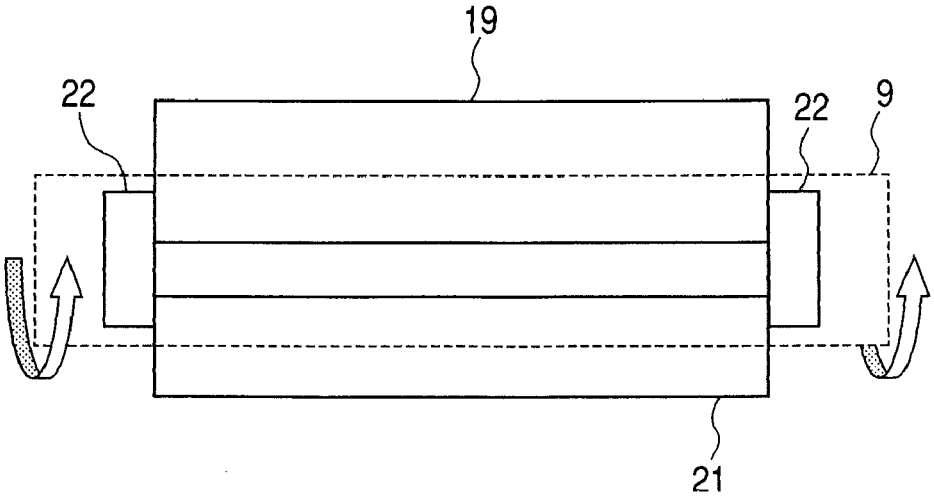
FIG. 14B is a schematic view as viewed from the inside of cleaning unit 15, showing the schematic constitution of a portion where a cleaning blade 19 and an electrophotographic photosensitive member 9 shown in FIG. 14A are brought into contact with each other.

Transfer residual toner recovered by the cleaning unit 15 is transported as recovered toner to a recovered toner container (not shown) in a cleaning frame 20. A sheet member 21 is assembled in the cleaning frame 20. The sheet member 21 is positioned on the upstream side of the direction in which the electrophotographic photosensitive member 1 moves with respect to the cleaning blade 19, and comes in weak contact with the surface of the electrophotographic photosensitive member to scoop the transfer residual toner scraped by the cleaning blade 11. In addition, gaps arise among the electrophotographic photosensitive member 9, the cleaning unit 15, the sheet member 21, and the cleaning frame 20 at an edge portion in the longitudinal direction of the cleaning unit. Accordingly, a seal member (reference numeral 22 in FIG. 14B) is installed to prevent the recovered toner from leaking through the gaps to the outside of the container. The electrophotographic photosensitive member according to the present invention can be used in a cleaning-less system using no cleaning unit.

The case where the charging unit 11 is a contact charging unit using a charging roller or the like as illustrated in FIG. 14A does not necessarily need pre-exposure.

In addition, the electrophotographic photosensitive member 9 and at least one unit selected from the group consisting of the charging unit 11, the developing unit 13, and the cleaning unit 15 may be stored in a container and integrally held together to constitute a process cartridge. The process cartridge may be formed so as to be freely detachable from the main body of an electrophotographic apparatus in a copying machine or in a laser beam printer. In FIG. 14A, the electrophotographic photosensitive member 9, the charging unit 11, the developing unit 13, and the cleaning unit 15 are integrally supported to make up a cartridge. Such a cartridge as a process cartridge 17 is mounted on the main body of the electrophotographic apparatus by using a guiding unit 18 such as a rail of the main body of the electrophotographic apparatus.

EXPERIMENTAL EXAMPLE

Hereinafter, the present invention will be described in more detail by way of specific examples. The term "part(s)" in the Experimental Examples means "part(s) by mass".

Experimental Example 1

<Production of Surface Layer>

First, a glass substrate of 76×52 mm having a thickness of 2 mm was used as a support. Next, a coating liquid for a surface layer was prepared by dissolving the following components in the mixed solvent of 600 parts of monochlorobenzene and 200 parts of methylal.

| | |
|---|---|
| Hole transportable compound represented by the following structural formula | 70 parts |

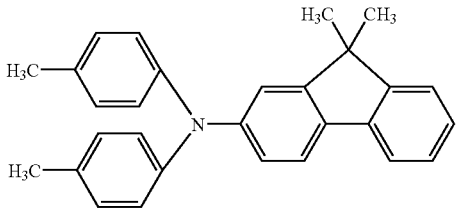

| | |
|---|---|
| Polycarbonate resin (trade name: IUPILON Z400, manufactured by MITSUI MINING & SMELTING CO., LTD. and Mitsubishi Engineering-Plastics Corporation) | 100 parts |

The above coating liquid for a surface layer was applied onto the glass substrate by a bar coating method, and was dried under heat in an oven at 90° C. for 40 minutes, whereby a surface layer having a thickness of 20 μm was formed.

<Formation of Depressed Portions>

The glass substrate with the surface layer was rubbed with waterproof paper at a pressure of 100 g/cm$^2$ and an angle of about 135°, whereby a large number of stripe-like depressed portions were formed. Here, the waterproof paper is a WATERPROOF ABRASIVE PAPER ELECTROSTATIC COATED SILICON CARBIDE MODEL P1000 manufactured by BOSS.

<Observation of Formed Depressed Portions>

The surface shape of the resultant sample was observed under magnification with a laser microscope (VK-9500, manufactured by KEYENCE CORPORATION). As a result, it was found that a large number of stripe-like depressed portions each having a short axis diameter Lpc in the range of 5.0 to 10.0 μm, a depth Rdv in the range of 0.5 to 2.0 μm, and an angle in the range of 133 to 137° were formed in the surface.

<Observation of Behavior of Toner>

Figure 15:
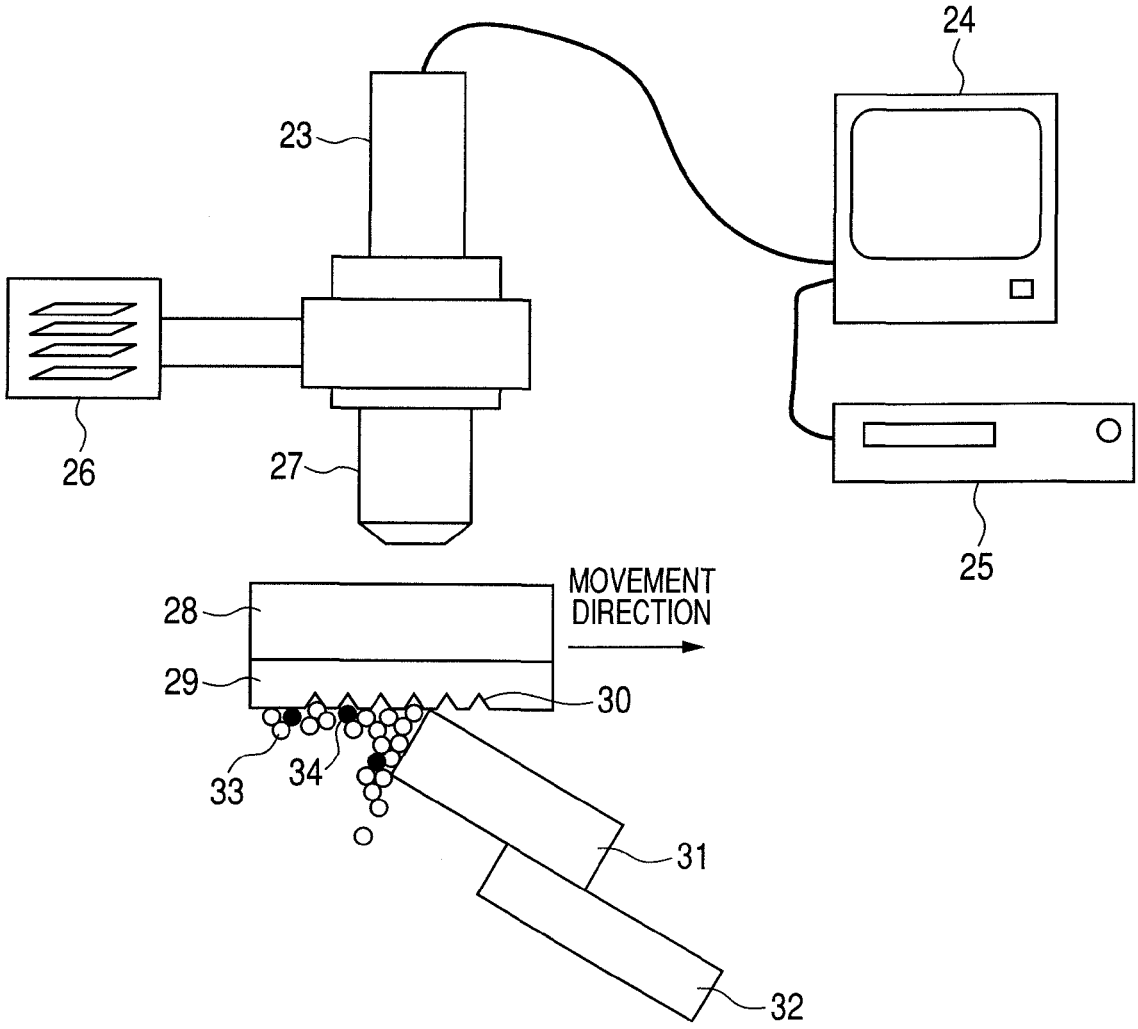
FIG. 15 is a schematic view of an observing apparatus used in evaluation.

FIG. 15 shows a schematic view of an apparatus used in the observation of behavior of toner.

The observation was performed as described below. First, the glass substrate with the surface layer after the formation of the depressed portions was prepared, and the toner was adhered to the surface layer so as to coat the layer thinly. Next, the surface to which the toner adhered was directed downward, and the glass substrate was set in the apparatus so that the surface to which the toner adhered was brought into contact with a cleaning blade. Subsequently, the behavior of toner particles near a nip between the cleaning blade and the surface layer was observed with an optical microscope while the glass substrate was moved in a counter direction with respect to the cleaning blade. In this case, a contact angle formed between the direction in which the glass substrate moved and each of the stripe-like depressed portions was 133 to 137°. The optical microscope used in the observation had a magnification of 340. The cleaning blade was made of a silicone rubber, and had a thickness of 5 mm, a width of 5 mm, and a free length of 15 mm, and an angle formed between the surface of the surface layer and the cleaning blade was 25°. The toner for observation used here was as follows: a cyan toner and a magenta toner for a digital color copying machine iRC6800 manufactured by Canon Inc. were prepared, and the cyan toner was mixed with 0.5% of the magenta toner so that the behavior of the toner could be easily observed. The cyan toner had a weight average particle diameter of 6.6 μm, and the magenta toner had a weight average particle diameter of 6.7 μm. Table 1 below shows the observation results of the behavior of the toner.

Experimental Example 2

First, a glass substrate with a surface layer was produced in the same manner as in Experimental Example 1.

<Formation of Depressed Portions>

Next, the glass substrate with the surface layer was rubbed with an abrasive sheet (Model GC#2000, manufactured by Nihon Ref-Lite Co., Ltd.) at a pressure of 100 g/cm$^2$ and an angle of about 135°, whereby a large number of stripe-like depressed portions were formed.

<Observation of Formed Depressed Portions>

The surface shape of the resultant sample was observed in the same manner as in Experimental Example 1. The observation showed that a large number of stripe-like depressed portions each having a short axis diameter Lpc in the range of 5.0 to 7.0 μm, a depth Rdv in the range of 0.1 to 0.2 μm, and an angle in the range of 133 to 137° were formed.

<Observation of Behavior of Toner>

The observation was performed in the same manner as in Experimental Example 1. Table 1 below shows the results.

Experimental Example 3

A glass substrate with a surface layer was produced in the same manner as in Experimental Example 1, but no depressed portions were formed in the surface layer.

<Observation of Behavior of Toner>

The observation was performed in the same manner as in Experimental Example 1. Table 1 below shows the results.

TABLE 1

| | Range of Lpc | Range of Rdv | Range of angle θ | Presence or absence of lateral movement | Weight average particle diameter of toner for observation Cyan/magenta |
|---|---|---|---|---|---|
| Experimental Example 1 | 5~10 μm | 0.5~2.0 μm | 133-137 degrees | Present | 6.6/6.7 μm |
| Experimental Example 2 | 5~7 μm | 0.1~0.2 μm | 133-137 degrees | Absent | 6.6/6.7 μm |
| Experimental Example 3 | — | — | — | Absent | 6.6/6.7 μm |

As can be seen from Experimental Example 1, the presence of depressed portions each having a depth Rdv of 2.0 μm or less and a short axis diameter Lpc of 10.0 μm or less exerts the effect of sweeping away the toner in the long axis direction of each of the depressed portions.

Meanwhile, as can be seen from Experimental Examples 2 and 3, the depth Rdv of each of the depressed portions must be larger than 0.2 μm in order to obtain the effect of sweeping away the toner in the long axis direction of each of the depressed portions. In addition, it can be found by calculation that the depth to which a sphere having a diameter of 5.0 μm is caught in a depressed portion having a depth of 0.2 μm is not changed when the short axis diameter of the depressed portion becomes equal to or larger than 1.96 μm. Accordingly, in the case where the short axis diameter Lpc of each of the depressed portions is less than 2.0 μm, the effect may not be obtained such that the toner is swept away in the long axis direction of each of the depressed portions.

Experimental Example 4

<Production of Photosensitive Member>

An aluminum cylinder having a diameter of 30 mm and a length of 357.5 mm was used as a support (cylindrical support).

Next, a solution composed of the following components was dispersed with a ball mill for about 20 hours, whereby a coating liquid for a conductive layer was prepared.

| | |
|---|---|
| Powder composed of barium sulfate particles each having a tin oxide coating layer (trade name: PASTRAN PC1, manufactured by MITSUI MINING & SMELTING CO., LTD.) | 60 parts |
| Titanium oxide (trade name: TITANIX JR, manufactured by TAYCA CORPORATION) | 15 parts |
| Resol type phenol resin (trade name: PHENOLITE J-325, manufactured by DAINIPPON INK AND CHEMICALS, solid content 70 mass %) | 43 parts |
| Silicone oil (trade name: SH 28 PA, manufactured by Dow Corning Toray Silicone Co., Ltd.) | 0.015 part |

-continued

| | |
|---|---|
| Silicone resin (trade name: TOSPEARL 120, manufactured by Momentive Performance Materials Inc.) | 3.6 parts |
| 2-methoxy-1-propanol | 50 parts |
| Methanol | 50 parts |

The coating liquid for a conductive layer thus prepared was applied onto the aluminum cylinder by a dipping method, and was cured under heat in an oven at a temperature of 140° C. for 1 hour, whereby a resin layer having a thickness of 15 μm was formed.

Next, the following components were dissolved in a mixed liquid of 400 parts of methanol and 200 parts of n-butanol.

| | |
|---|---|
| Copolymerized nylon resin (trade name: AMILAN CM8000, manufactured by Toray Industries, Inc.) | 10 parts |
| Methoxymethylated 6 nylon resin (trade name: TORESIN EF-30T, manufactured by Nagase ChemteX Corporation) | 30 parts |

The upper portion of the above-mentioned resin layer was immersed in and coated with the coating liquid for an intermediate layer thus prepared, and was dried under heat in an oven at a temperature of 100° C. for 30 minutes, whereby an intermediate layer having a thickness of 0.45 μm was formed.

Next, the following components were dispersed with a sand mill device using glass beads each having a diameter of 1 mm for 4 hours. After that, 700 parts of ethyl acetate were added to the resultant, whereby a dispersion liquid for a charge generating layer was prepared.

| | |
|---|---|
| Hydroxygallium phthalocyanine (having strong peaks at Bragg angles 2θ ± 0.2° of 7.4° and 28.2° in CuKα characteristic X-ray diffraction) | 20 parts |
| Calixarene compound represented by the following structural formula | 0.2 part |

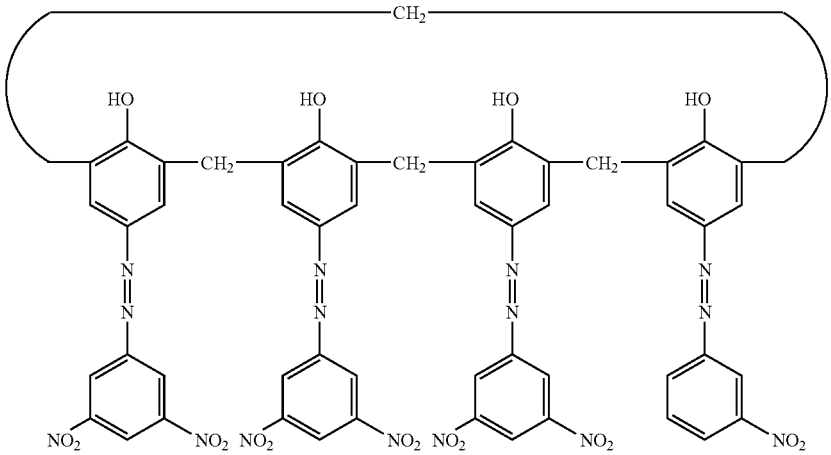

| | |
|---|---|
| Polyvinyl butyral (trade name: S-LEC BX-1, manufactured by SEKISUI SHEMICAL CO., LTD.) | 10 parts |
| Cyclohexanone | 600 parts |

The dispersion liquid was applied by a dipping coating method, and was dried under heat in an oven at a temperature of 80° C. for 15 minutes, whereby a charge generating layer having a thickness of 0.170 μm was formed.

Next, a coating liquid for a charge transporting layer was prepared by dissolving the following components in a mixed solvent of 600 parts of monochlorobenzene and 200 parts of methylal.

Hole transportable compound represented by the following structural formula — 70 parts

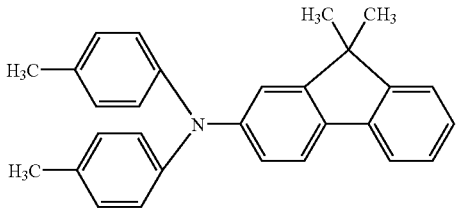

Resin represented by the following structural formula — 100 parts

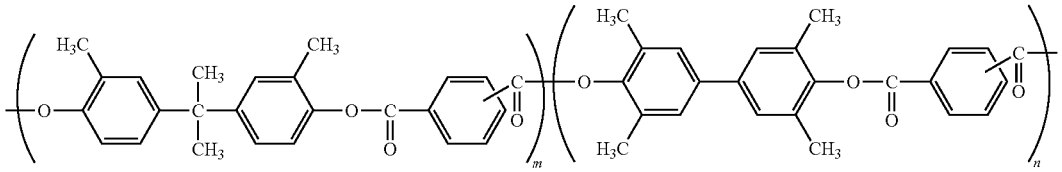

(Copolymerization ratio m:n = 7:3; weight average molecular weight: 130,000)

The coating liquid for a charge transporting layer thus prepared was applied onto the charge generating layer by dip coating, and was dried under heat in an oven at 100° C. for 30 minutes, whereby a charge transporting layer having a thickness of 27 μm was formed. Thus, the photosensitive layer of an electrophotographic photosensitive member was obtained.

<Formation of Depressed Portions>

Figure 16A:
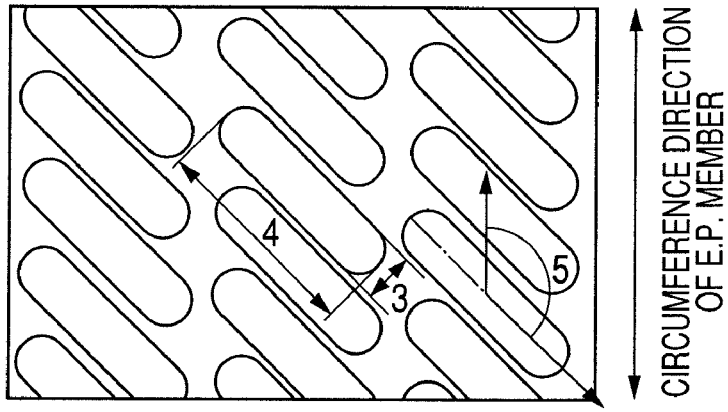
FIG. 16A is a plan view of the shape of a mold used in Experimental Example 4, as viewed from the side of a pressure device A of FIG. 12.
Figure 16B:
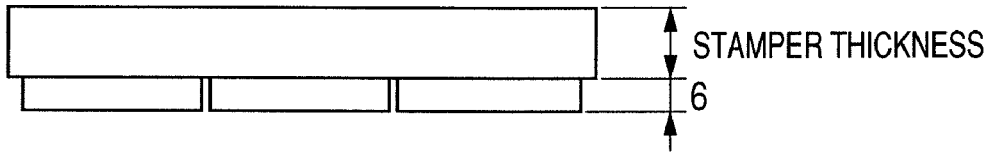
FIG. 16B is a side view of the mold.

The resultant electrophotographic photosensitive member was placed in a surface shape processing apparatus shown in FIG. 12 in an environment at room temperature, i.e., 25° C. The pressurizing member of the surface shape processing apparatus was made of SUS, and a heater for heating was placed inside the member. A nickel plate having a thickness of 200 μm and such projected shapes as shown in each of FIGS. 16A and 16B was used as a mold for shape transfer, and was fixed on the pressurizing member. The projected shapes each had a long axis diameter of 19.5 μm, a short axis diameter of 3.3 μm, and a height of 3.0 μm. In addition, an obtuse angle formed between the circumferential direction of the photosensitive member and the long axis diameter of each of the projected shapes at the time of the surface processing of the photosensitive member was set to 135°. A cylindrical holding member made of SUS and having substantially the same diameter as the inner diameter of the support was inserted into the support. In this case, the temperature of the holding member was not controlled. The surface processing of the electrophotographic photosensitive member was performed by using the apparatus having the foregoing constitution at a mold temperature of 145° C., an applied pressure of 7.84 $N/mm^2$, and a processing speed of 10 mm/sec. In addition, the glass transition temperature of the charge transporting layer separately measured was 85° C., and the melting point of the charge transport substance separately measured was 141° C. It should be noted that the temperature of the support 35° C. is a temperature at the times of the initiation and completion of the processing.

In addition, the temperature of each of the mold and the support was measured by the following method. The temperature of the mold was measured by bringing a tape contact type thermocouple (ST-14K-008-TS1.5-ANP, manufactured by Anritsu Meter Co., Ltd.) into contact with the surface of the mold. The temperature of the support was measured by previously placing the tape contact type thermocouple on the inner face of the support in advance.

<Observation of Formed Depressed Portions>

The surface shape of the resultant sample was observed under magnification with a laser microscope (VK-9500, manufactured by KEYENCE CORPORATION). As a result, it was found that in the region processed with the mold, 50 long hole-like depressed portions per 100 $\mu m^2$ were formed which have an average long axis diameter Rpc-A of 19.5 μm, an average short axis diameter Lpc-A of 3.3 μm, and an average depth Rdv-A of 1.5 μm, and in which an obtuse angle θ formed between the direction in which the surface of the photosensitive member moved at the time of observing the behavior of toner as described later and the long axis of the depressed portion was 135°.

<Observation of Behavior of Toner>

Figure 17:
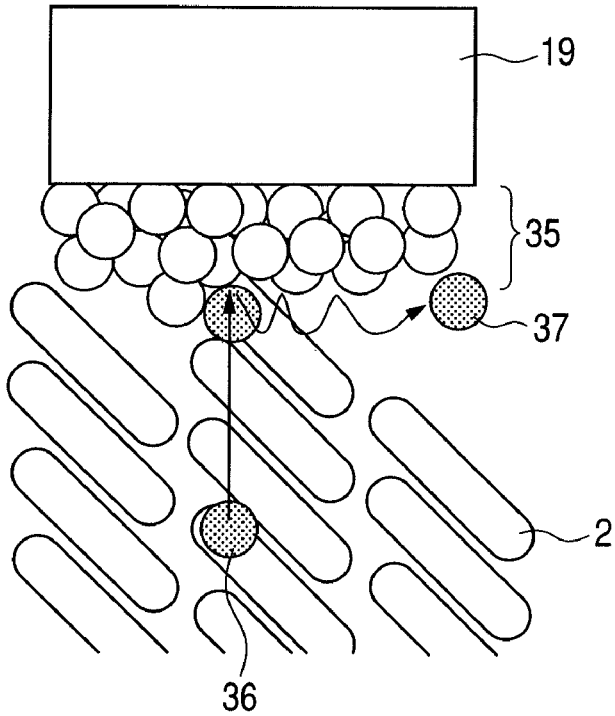
FIG. 17 is a schematic view showing the observed manner in which toner moves.

As shown in FIG. 15, the photosensitive member after the formation of the depressed portions to which toner particles had been adhered was set so as to come into contact with the cleaning blade. The behavior of toner particles near a nip between the cleaning blade and the photosensitive member was observed with an optical microscope while the photosensitive member was subjected to a rotational movement in a counter direction with respect to the cleaning blade. The optical microscope was a commercially available one having a magnification of 85. The cleaning blade was made of a silicone rubber, and had a thickness of 5 mm, an angle formed in relation to a tangent to the photosensitive member of 25°, a width of 5 mm, and a free length of 15 mm. A magenta toner for a digital color copying machine IRC6800 manufactured by Canon Inc. was used as the toner for observation. FIG. 17 shows a schematic view showing the lateral movement of the toner. In addition, Table 2 shows the results.

Experimental Example 5

A photosensitive member was produced, and depressed portions were formed in the same manner as in Experimental Example 4 except that the angle θ was changed to 113°. Then, the behavior of toner was observed. Table 2 shows the results.

Experimental Example 6

A photosensitive member was produced, and depressed portions were formed in the same manner as in Experimental Example 4 except that the angle 9 was changed to 148°. Then, the behavior of toner was observed. Table 2 shows the results.

Experimental Example 7

A photosensitive member was produced, and depressed portions were formed in the same manner as in Experimental Example 4 except that the angle θ was changed to 90°. Then, the behavior of toner was observed. Table 2 shows the results.

Experimental Example 8

A photosensitive member was produced, and depressed portions were formed in the same manner as in Experimental Example 4 except that the angle θ was changed to 180°. Then, the behavior of toner was observed. Table 2 shows the results.

TABLE 2

| | (Lpc-A) (μm) | (Rpc-A) (μm) | (Rdv-A) (μm) | Angle θ (degrees) | Presence or absence of lateral movement | Weight average particle diameter of toner for observation (μm) |
|---|---|---|---|---|---|---|
| Experimental Example 4 | 1.5 | 19.5 | 1.5 | 135 | Present | 6.7 |
| Experimental Example 5 | 1.5 | 19.5 | 1.5 | 113 | Present | 6.7 |
| Experimental Example 6 | 1.5 | 19.5 | 1.5 | 148 | Present | 6.7 |
| Experimental Example 7 | 1.5 | 19.5 | 1.5 | 90 | Absent | 6.7 |
| Experimental Example 8 | 1.5 | 19.5 | 1.5 | 180 | Absent | 6.7 |

As can be seen from Table 2, even in the case of a cylindrical photosensitive member, when the angle θ satisfies the relationship of 90°<θ<180°, the effect can be obtained such that the toner is swept away along the long axis direction of each of the depressed portions.

EXAMPLES

Hereinafter, examples of the present invention will be described. However, the present invention is not limited to the following examples. The term "part(s)" in the Examples refers to "part(s) by mass".

<Production of Electrophotographic Photosensitive Member A>

A conductive layer, an intermediate layer, a charge generating layer, and a charge transporting layer were formed in the same manner as in Experimental Example 4 except that an aluminum cylinder having an outside diameter of 30 mm and a length of 370 mm was used as a support (cylindrical support). Thus, an electrophotographic photosensitive member A was obtained.

<Production of Electrophotographic Photosensitive Member B>

An aluminum cylinder having a diameter of 30 mm and a length of 370 mm was used as a support (cylindrical support).

Next, a solution formed of the following components was dispersed with a ball mill for about 20 hours, whereby a coating liquid for a conductive layer was prepared.

| | |
|---|---|
| Powder composed of barium sulfate particles each having a tin oxide coating layer (trade name: PASTRAN PC1, manufactured by MITSUI MINING & SMELTING CO., LTD.) | 60 parts |
| Titanium oxide (trade name: TITANIX JR, manufactured by TAYCA CORPORATION) | 15 parts |
| Resol type phenol resin (trade name: PHENOLITE J-325, manufactured by DAINIPPON INK AND CHEMICALS, solid content 70 mass %) | 43 parts |
| Silicone oil (trade name: SH 28 PA, manufactured by Dow Corning Toray Silicone Co., Ltd.) | 0.015 part |
| Silicone resin (trade name: TOSPEARL 120, manufactured by Momentive Performance Materials Inc.) | 3.6 parts |
| 2-methoxy-1-propanol | 50 parts |
| Methanol | 50 parts |

The coating liquid for an intermediate layer thus prepared was applied onto the above-mentioned resin layer by a dipping method, and was cured under heat in an oven at a temperature of 140° C. for 1 hour, whereby an intermediate layer having a thickness of 15 μm was formed.

Next, the following components were dissolved in a mixed liquid of 400 parts of methanol and 200 parts of n-butanol.

| | |
|---|---|
| Copolymerized nylon resin (trade name: AMILAN CM8000, manufactured by Toray Industries, Inc.) | 10 parts |
| Methoxymethylated 6 nylon resin (trade name: TORESIN EF-30T, manufactured by Nagase ChemteX Corporation) | 30 parts |

The coating for a conductive layer thus prepared was applied onto the aluminum cylinder by a dipping method, and was cured under heat in an oven at a temperature of 100° C. for 30 minutes, whereby a resin layer having a thickness of 0.45 μm was formed.

Next, the following components were dispersed by means of a sand mill device using glass beads each having a diameter of 1 mm for 4 hours. After that, 700 parts of ethyl acetate was added to the resultant, whereby a dispersion liquid for a charge generating layer was prepared.

| | |
|---|---|
| Hydroxygallium phthalocyanine (having a strong peak at Bragg angles 2θ ± 0.2° of each of 7.4° and 28.2° in CuKα characteristic X-ray diffraction) | 20 parts |

-continued

| | |
|---|---|
| Calixarene compound represented by the following structural formula | 0.2 part |

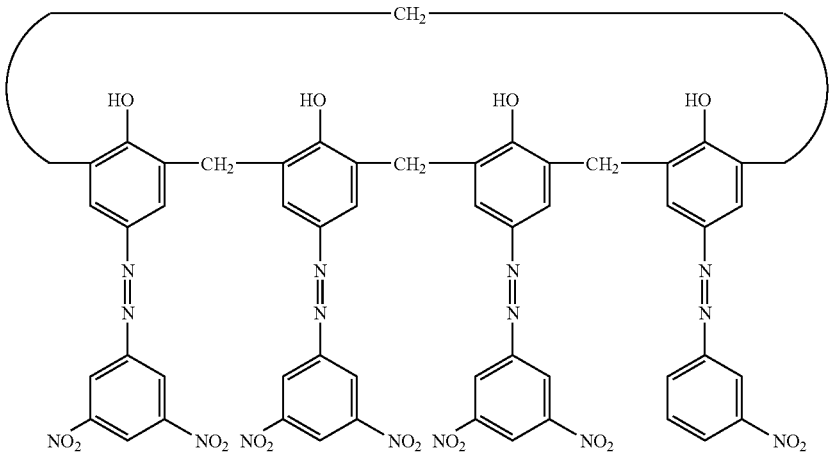

| | |
|---|---|
| Polyvinyl butyral (trade name: S-LEC BX-1, manufactured by SEKISUI CHEMICAL CO., LTD.) | 10 parts |
| Cyclohexanone | 600 parts |

The dispersion liquid was applied by a dipping coating method, and was dried under heat in an oven at a temperature of 80° C. for 15 minutes, whereby a charge generating layer having a thickness of 0.170 μm was formed.

Next, a coating liquid for a charge transporting layer was prepared by dissolving the following components in a mixed solvent of 600 parts of monochlorobenzene and 200 parts of methylal.

| | |
|---|---|
| Hole transportable compound represented by the following structural formula | 70 parts |

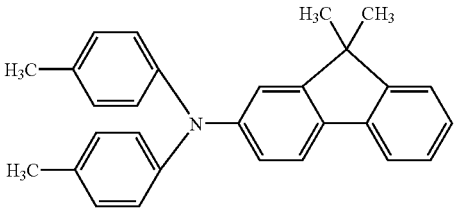

| | |
|---|---|
| Polycarbonate resin (trade name: IUPILON Z400, manufactured by Mitsubishi Engineering-Plastics Corporation) | 100 parts |

The paint for a conductive layer thus prepared was applied onto the charge generating layer by a dipping method, and was cured under heat in an oven at a temperature of 90° C. for 40 minutes, whereby a charge transporting layer having a thickness of 18 μm was formed.

Next, the following component was dissolved as a dispersant in a mixed solvent of 20 parts of 1,1,2,2,3,3,4-heptafluorocyclopentane (trade name: ZEORORA H, manufactured by ZEON CORPORATION) and 20 parts of 1-propanol.

| | |
|---|---|
| Fluorine atom-containing resin (trade name: GF-300, manufactured by TOAGOSEI CO., LTD.) | 0.5 part |

The following component was added as a lubricant to the resultant solution.

| | |
|---|---|
| Tetrafluoroethylene resin powder (trade name: RUBRON L-2, manufactured by DAIKIN INDUSTRIES, ltd.) | 10 parts |

After that, the resultant was processed four times with a high-pressure dispersing machine (trade name: MICROFLUIDIZER M-110EH, manufactured by Microfluidics) at a pressure of 0.588 Pa for uniform dispersion. Further, the resultant was filtrated through a polyflon filter (trade name: PF-040, manufactured by ADVANTEC), whereby a lubricant-dispersed liquid was prepared.

Next, the following components were added to the lubricant-dispersed liquid.

| | |
|---|---|
| Hole transportable compound represented by the following formula | 90 parts |
| 1,1,2,2,3,3,4-heptafluorocyclopentane | 70 parts |
| 1-propanol | 70 parts |

The resultant was then filtrated through the following filter, whereby a coating liquid for a second charge transporting layer was prepared.

Polyflon filter (trade name: PF-020, manufactured by ADVANTEC)

The coating liquid for a second charge transporting layer was applied onto the charge transporting layer, and was then dried in the air in an oven at a temperature of 50° C. for 10 minutes. After that, the resultant was irradiated with electron beams for 1.6 seconds in nitrogen under conditions including an accelerating voltage of 150 kV and a beam current of 3.0 mA while the cylinder was rotated at 300 rpm. Subsequently, the resultant was subjected to a curing reaction in nitrogen while the temperature of the resultant was increased from 25° C. to 110° C. over 30 seconds. It should be noted that the absorbed dose of the electron beams measured at this time was 18 kGy. In addition, the oxygen concentration of an atmosphere for the irradiation with the electron beams and for the curing reaction under heat was 15 ppm or less. The resultant was then naturally cooled to a temperature of 25° C. in the air, and was subjected to post-heating treatment in the air in an oven at a temperature of 100° C. for 30 minutes so that a protective layer (second charge transporting layer) having a thickness of 5 μm would be formed. As a result, an electrophotographic photosensitive member B was obtained.

Example 1

<Formation of Depressed Portions>

Figure 18A:
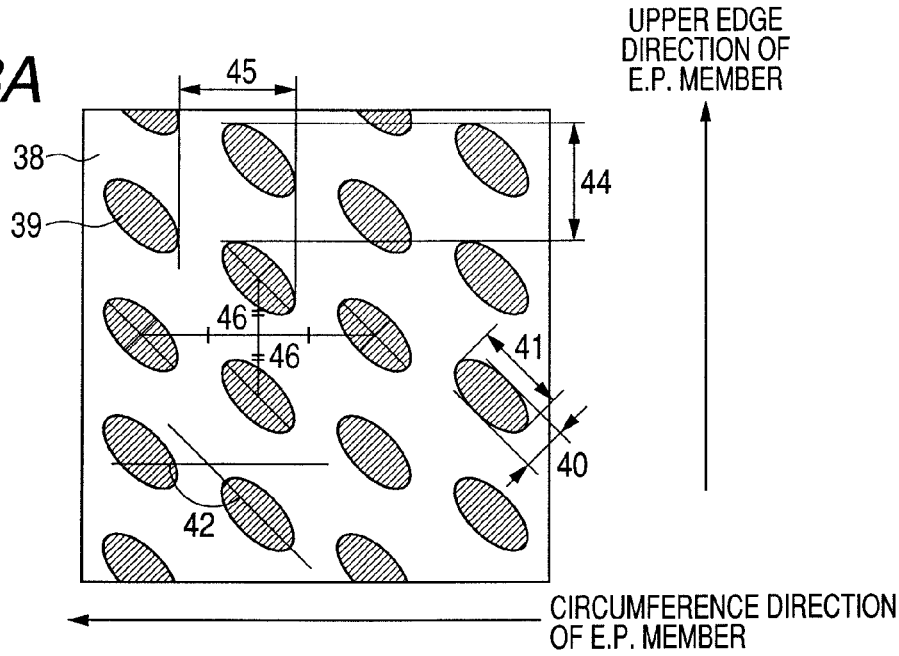
FIG. 18A is a plan view of the shape of a mold for processing the upper edge side of the electrophotographic photosensitive member used in Example 1, as viewed from the side of the pressure device A of FIG. 12.
Figure 18B:
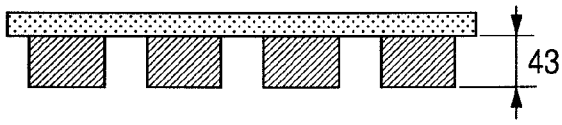
FIG. 18B is a side view of the mold.

The electrophotographic photosensitive member B was subjected to surface processing by placing a mold for shape transfer having such projected portions as shown in each of FIGS. 18A and 18B (columnar shapes each having a height of 2.0 μm and an elliptical section with a short axis diameter of 2.0 μm and a long axis diameter of 4.0 μm, angle θ=135° measured counterclockwise from the left-hand side of a horizontal direction when viewed as shown in FIG. 18A taking the upper edge of the electrophotographic photosensitive member as an upward direction and the circumferential direction of the electrophotographic photosensitive member as the horizontal direction, vertical interval: 5 μm, lateral interval: 5 μm, a vertical shift width between adjacent projected portions was one half of the vertical interval) in the apparatus having the constitution shown in FIG. 12. The mold was a nickel plate having a thickness of 50 μm, and was used while being fixed onto the pressurizing member of the surface shape processing apparatus. In addition, when processing was performed, a cylindrical holding member made of SUS and having substantially the same diameter as the inside diameter of the support was inserted into the support. In this case, the temperature of the holding member was not controlled. At the time of the surface processing, the temperature of each of the electrophotographic photosensitive member and the mold was controlled so that the temperature of the surface of the electrophotographic photosensitive member was 145° C., and shape transfer was performed by rotating the photosensitive member in the circumferential direction at a speed of 10 mm/sec while pressurizing the photosensitive member at a pressure of 7.84 N/mm$^2$. The surface processing was performed for a region corresponding to one cycle in the circumferential direction of the electrophotographic photosensitive member in the range of 25 mm or more and 37 mm or less measured from the upper edge of the electrophotographic photosensitive member.

Figure 18C:
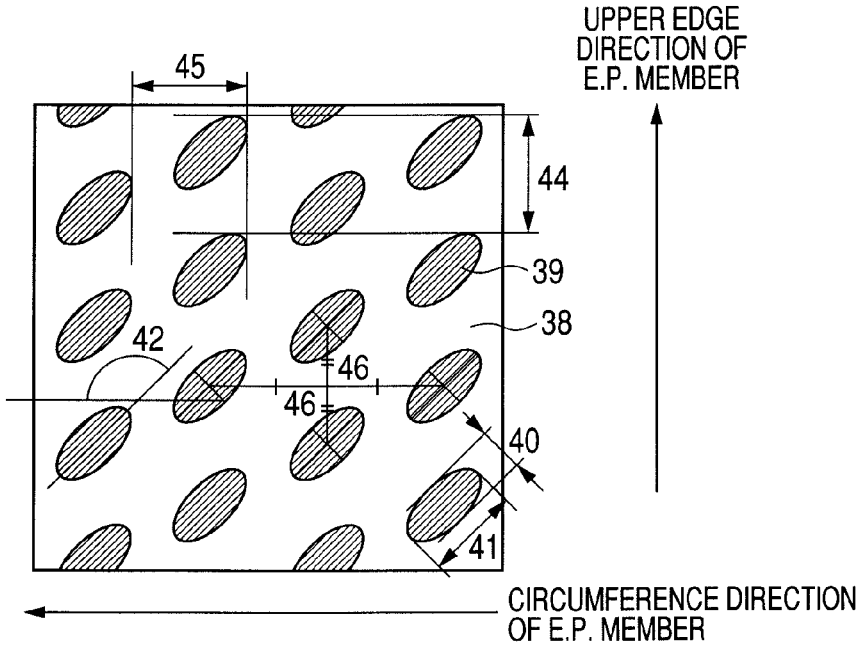
FIG. 18C is a plan view of the shape of a mold used in Example 1 for processing the lower edge side of the electrophotographic photosensitive member, as viewed from the side of the pressure device A of FIG. 12.
Figure 18D:
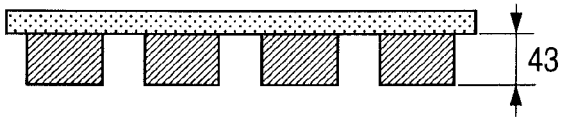
FIG. 18D is a side view of the mold.

Subsequently, the electrophotographic photosensitive member was subjected to surface processing by placing a mold having such projected shapes as shown in each of FIGS. 18C and 18D (columnar shapes each having a height of 2.0 μm and an elliptical section with a short axis diameter of 2.0 μm and a long axis diameter of 4.0 μm, angle θ=135° measured clockwise from the left-hand side of a horizontal direction when viewed as shown in FIG. 18C taking the upper edge of the electrophotographic photosensitive member as an upward direction and the circumferential direction of the electrophotographic photosensitive member as the horizontal direction, vertical interval: 5 μm, lateral interval: 5 μm) in the apparatus having the constitution shown in FIG. 12. The mold was a nickel plate having a thickness of 50 μm, and was used while being fixed onto the pressurizing member of the surface shape processing apparatus. In addition, when processing was performed, a cylindrical holding member made of SUS and having substantially the same diameter as the inside diameter of the support was inserted into the support. In this case, the temperature of the holding member was not controlled. At the time of the surface processing, the temperature of each of the electrophotographic photosensitive member and the mold was controlled so that the temperature of the surface of the electrophotographic photosensitive member was 145° C., and shape transfer was performed by rotating the photosensitive member in the circumferential direction at a speed of 10 mm/sec while pressurizing the photosensitive member at a pressure of 7.84 N/mm$^2$. It should be noted that the surface processing was performed for a region corresponding to one cycle in the circumferential direction of the electrophotographic photosensitive member in the range of 15 mm or more and 25 mm or less measured from the lower edge of the electrophotographic photosensitive member.

The upper edge side and lower edge side of the electrophotographic photosensitive member were subjected to surface processing as described above, whereby an electrophotographic photosensitive member of Example 1 was obtained.

<Observation of Formed Depressed Portions>

Figure 19A:
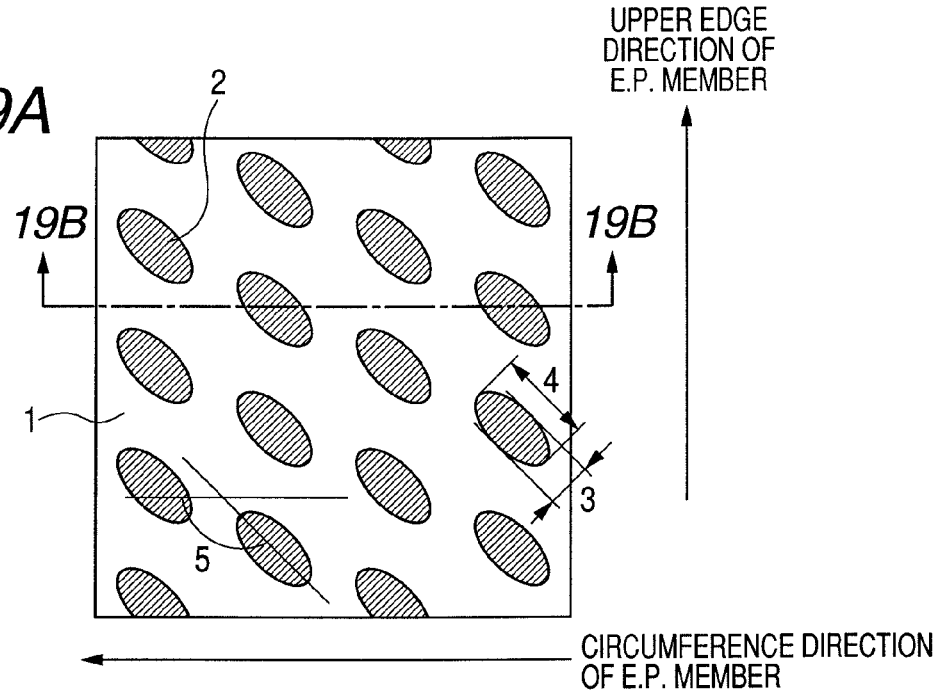
FIG. 19A is a plan view showing depressed portions formed on the processed surface on the upper edge side of the electrophotographic photosensitive member in Example 1.
Figure 19B:
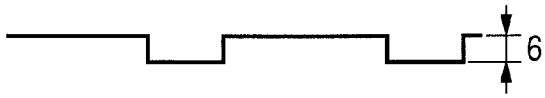
FIG. 19B is a sectional view taken along the line 19B-19B of FIG. 19A.

The surface shape of the resultant electrophotographic photosensitive member was observed under magnification with a laser microscope (VK-9500 manufactured by KEYENCE CORPORATION). As a result, it was found that, as shown in FIGS. 19A and 19B, columnar depressed portions having elliptical opening portions with an average short axis diameter Lpc-A of 2.0 μm and an average long axis diameter Rpc-A of 4.0 μm, and having an average depth Rdv-A of 1.1 μm, were formed in the region of 25 mm or more and 37 mm or less measured from the upper edge of the electrophotographic photosensitive member. An angle formed between the long axis of each of the depressed portions and the circumferential direction of the electrophotographic photosensitive member was 135° as measured counterclockwise from the left-hand side of a horizontal direction when being viewed taking the upper edge of the electrophotographic photosensitive member as an upward direction and the circumferential direction of the electrophotographic photosensitive member as the horizontal direction. The number of depressed portions per 100 μm square was 400.

Figure 19C:
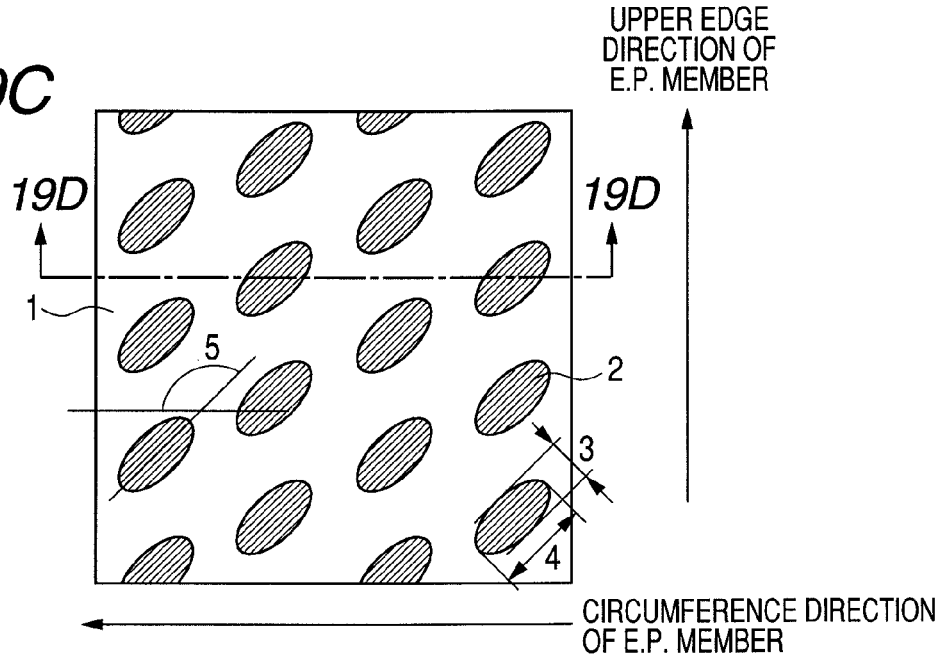
FIG. 19C is a plan view showing depressed portions formed on the processed surface on the lower edge side of the electrophotographic photosensitive member in Example 1.
Figure 19D:
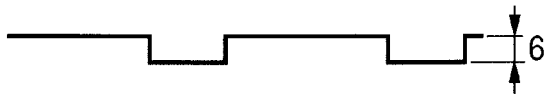
FIG. 19D is a sectional view taken along the line 19D-19D of FIG. 19C.

Meanwhile, it was found that, as shown in FIGS. 19C and 19D, columnar depressed portions having elliptical opening portions with an average short axis diameter Lpc-A of 2.0 μm and an average long axis diameter Rpc-A of 4.0 μm, and having an average depth Rdv-A of 1.1 μm, were formed in the range of 15 mm or more and 25 mm or less measured from the lower edge of the electrophotographic photosensitive member. An angle formed between the long axis of each of the depressed portions and the circumferential direction of the electrophotographic photosensitive member was 135° as measured clockwise from the left-hand side of a horizontal direction when being viewed taking the upper edge of the electrophotographic photosensitive member as an upward direction and the circumferential direction of the electrophotographic photosensitive member as the horizontal direction. The number of depressed portions per 100-μm square was 400.

<Evaluation of Electrophotographic Photosensitive Member>

The electrophotographic photosensitive member obtained as described above was mounted on a remodeled apparatus of an electrophotographic copying machine IR2870 manufactured by Canon Inc and evaluation was made.

The electrophotographic photosensitive member was mounted on a drum cartridge for the electrophotographic copying machine IR2870 so that the upper edge side of the electrophotographic photosensitive member corresponded to the back side of the reconstructed apparatus of the electrophotographic copying machine IR2870. In this case, the rotation direction of the electrophotographic photosensitive member is clockwise when viewed from the upper edge side of the electrophotographic photosensitive member.

The cleaning blade having been mounted on the drum cartridge for the electrophotographic copying machine IR2870 and the seal member attached to each of both sides in the longitudinal direction of the cleaning blade, were used as they were. 10 g of toner were loaded into a recovered toner container portion in the drum cartridge in advance so that the toner was brought into contact with the region where the depressed portions were formed in the surface of the electrophotographic photosensitive member after the photosensitive member had been mounted. The drum cartridge was mounted on the remodeled apparatus of the electrophotographic copying machine IR2870. The toner for evaluation used here had a weight average particle diameter of 5.0 μm.

The image printable region of the remodeled apparatus of the IR2870 corresponded to the range of from 37.5 mm to 344.5 mm in the upper edge side of the electrophotographic photosensitive member. Accordingly, the region where the depressed portions were formed in the surface of the electrophotographic photosensitive member was present outside the image printable region.

The evaluation was performed in a 23° C./50% RH environment. The initial potentials of the electrophotographic photosensitive member were adjusted as follows: the dark potential (Vd) and light potential (Vl) of the electrophotographic photosensitive member were −720 V and −220 V, respectively. After that, a 1,000-sheet durability test was performed on A4 size paper in a printing ratio of 5% by one-sheet intermittent printing.

After the completion of the durability test, the electrophotographic photosensitive member was removed from the drum cartridge. The surface of the seal member coming in contact with the electrophotographic photosensitive member was visually observed, and evaluation was made as below for the effect obtained by processing the surface of the electrophotographic photosensitive member of the present invention, i.e., the effect of sweeping away the toner toward the center of the electrophotographic photosensitive member.

A: The surface of the seal member coming in contact with the electrophotographic photosensitive member was not contaminated with the toner, and the leakage of recovered toner did not occur.

B: The surface of the seal member coming in contact with the electrophotographic photosensitive member was slightly contaminated with the toner, but the leakage of recovered toner did not occur.

C: The surface of the seal member coming in contract with the electrophotographic photosensitive member was contaminated with the toner, but the leakage of recovered toner did not occur.

D: The surface of the seal member coming in contact with the electrophotographic photosensitive member was contaminated with the toner, and the leakage of recovered toner occurred.

As a result, the surface of the seal member coming in contact with the electrophotographic photosensitive member was not contaminated with the toner, and the occurrence of the leakage of recovered toner was not observed.

Example 2

Figure 20A:
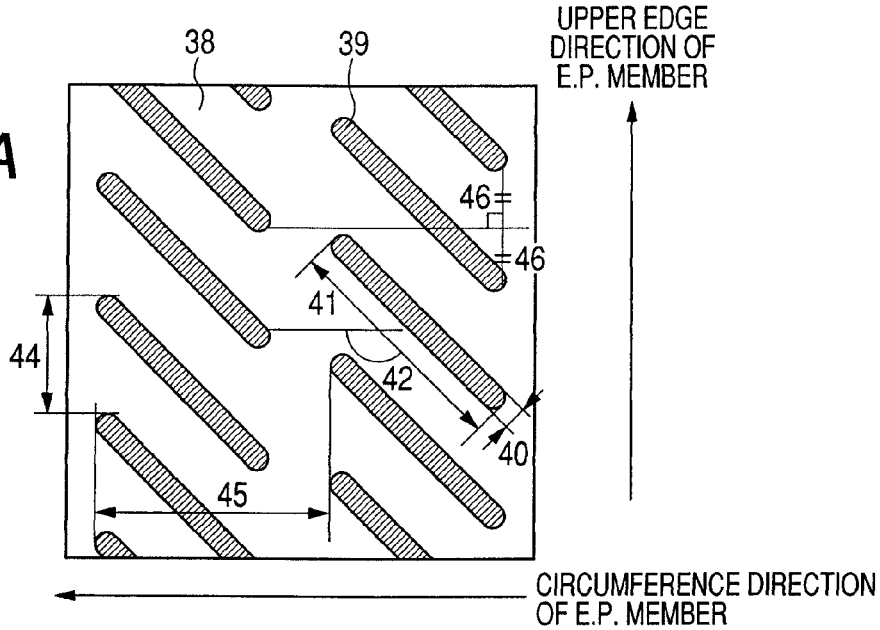
FIG. 20A is a plan view of the shape of a mold used in Example 2 for processing the upper edge side of the electrophotographic photosensitive member, as viewed from the side of the pressure device A of FIG. 12.
Figure 20B:
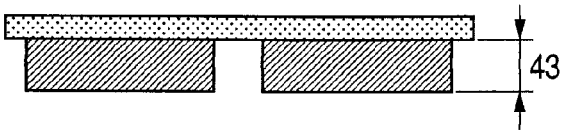
FIG. 20B is a side view of the mold.
Figure 20C:
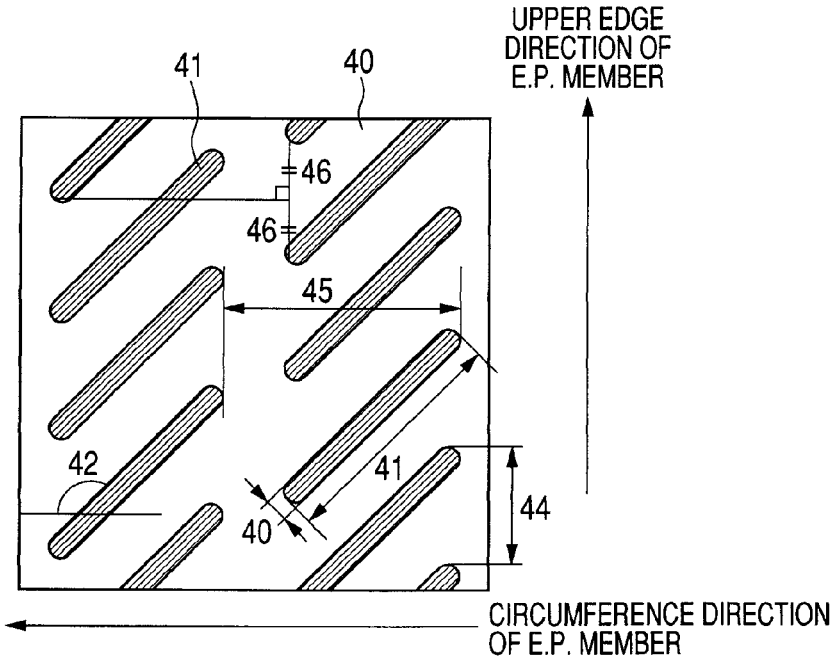
FIG. 20C is a plan view of the shape of a mold used in Example 2 for processing the lower edge side of the electrophotographic photosensitive member, as viewed from the side of the pressure device A of FIG. 12.
Figure 20D:
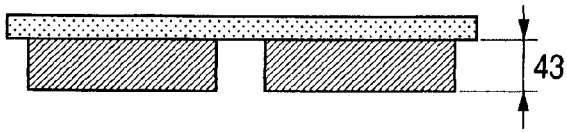
FIG. 20D is a side view of the mold.

An electrophotographic photosensitive member was produced in the same manner as in Example 1 except that: the electrophotographic photosensitive member B was used as an electrophotographic photosensitive member to be processed; and a mold having projected shapes shown in FIGS. 20A and 20B and a mold having projected shapes shown in FIGS. 20C and 20D (short axis diameter: 2.5 μm, long axis diameter: 10.0 μm, height: 2.0 μm, θ: 135°, vertical interval: 5 μm, lateral interval: 10 μm, a vertical shift width between adjacent projected shapes was one half of the vertical interval) were used as molds for shape transfer for the upper edge portion and lower edge portion of the electrophotographic photosensitive member, respectively. The surface shape of the photosensitive member was observed, and the photosensitive member was evaluated by a paper feeding durability test in the same manner as in Example 1. Table 3 shows a relationship among the electrophotographic photosensitive member to be processed, the projected shapes of each mold, and the weight average particle diameter of the toner, and Table 4 shows the observation results of the surface shape of the photosensitive member, and the evaluation result of the paper feeding durability test.

As can be seen from FIGS. 20A to 20D, the projected portions of each mold are arranged so that another projected portion is present on a straight line drawn from an edge portion in the long axis direction of one projected portion along the circumferential direction of the photosensitive member. The observation confirmed that the arrangement of the depressed portions transferred onto the photosensitive member also maintained such a relationship.

Examples 3 and 4

In each of Examples 3 and 4, the surface of an electrophotographic photosensitive member was processed in the same manner as in Example 2 except that an electrophotographic photosensitive member to be processed, the long axis diameter, short axis diameter, height, vertical interval, lateral interval, and angle θ of the projected portions of a mold, and the weight average particle diameter of toner to be used in evaluation were changed as shown in Table 3. The surface shape of the photosensitive member was observed, and the photosensitive member was evaluated by a paper feeding durability test in the same manner as in Example 2. Table 4 shows the observation results of the surface shape of the photosensitive member, and the evaluation results of the paper feeding durability test.

Comparative Example 1

An electrophotographic photosensitive member was produced in the same manner as in Example 1 except that no depressed portions were formed in the surface of the electrophotographic photosensitive member. The surface shape of the photosensitive member was observed, and the photosensitive member was evaluated by a paper feeding durability test in the same manner as in Example 1. Table 4 shows the evaluation result of the paper feeding durability test.

Comparative Examples 2 and 3

In each of Comparative Examples 2 and 3, the surface of an electrophotographic photosensitive member was processed in the same manner as in Example 2 except that an electrophotographic photosensitive member to be processed, the long axis diameter, short axis diameter, height, vertical interval, lateral interval, and angle θ of the projected portions of a mold, and the weight average particle diameter of toner to be used in evaluation were changed as shown in Table 3. The surface shape of the photosensitive member was observed, and the photosensitive member was evaluated by a paper feeding durability test in the same manner as in Example 2. Table 4 shows the observation results of the surface shape of the photosensitive member, and the evaluation results of the paper feeding durability test.

TABLE 3

| | Position at which surface of electrophotographic photosensitive member is processed | Short axis diameter of projected portion (μm) | Long axis diameter of projected portion (μm) | Height of projected portion (μm) | Vertical interval (μm) | Lateral interval (μm) | Angle θ (degrees) | Electrophotographic photosensitive member to be processed | Weight average particle diameter of toner(μm) |
|---|---|---|---|---|---|---|---|---|---|
| Example 1 | Upper edge side | 2.0 | 4.0 | 2.0 | 5.0 | 5.0 | 135 | B | 5.0 |
| | Lower edge side | 2.0 | 4.0 | 2.0 | 5.0 | 5.0 | 135 | | |
| Example 2 | Upper edge side | 2.5 | 10.0 | 2.0 | 5.0 | 10.0 | 135 | B | 5.0 |
| | Lower edge side | 2.5 | 10.0 | 2.0 | 5.0 | 10.0 | 135 | | |
| Example 3 | Upper edge side | 3.0 | 25.0 | 3.0 | 10.0 | 25.0 | 135 | A | 7.2 |
| | Lower edge side | 3.0 | 25.0 | 3.0 | 10.0 | 25.0 | 135 | | |
| Example 4 | Upper edge side | 4.0 | 50.0 | 3.0 | 20.0 | 50.0 | 135 | A | 5.0 |
| | Lower edge side | 4.0 | 50.0 | 3.0 | 20.0 | 50.0 | 135 | | |
| Comparative Example 1 | Upper edge side | — | — | — | — | — | — | B | 5.0 |
| | Lower edge side | — | — | — | — | — | — | | |
| Comparative Example 2 | Upper edge side | 2.0 | 3.0 | 1.0 | 5.0 | 5.0 | 135 | B | 5.0 |
| | Lower edge side | 2.0 | 3.0 | 1.0 | 5.0 | 5.0 | 135 | | |
| Comparative Example 3 | Upper edge side | 3.0 | 50.0 | 2.5 | 50.0 | 50.0 | 135 | A | 5.0 |
| | Lower edge side | 3.0 | 50.0 | 2.5 | 50.0 | 50.0 | 135 | | |

TABLE 4

| | Position at which surface of electrophotographic photosensitive member is processed | (Lpc-A) (μm) | (Rpc-A) (μm) | (Rdv-A) (μm) | Angle θ (degrees) | Number of depressed portions per 100 μm square (portions) | Result of durability test |
|---|---|---|---|---|---|---|---|
| Example 1 | Upper edge side | 2.0 | 4.0 | 1.1 | 135 | 400 | B |
| | Lower edge side | 2.0 | 4.0 | 1.1 | 135 | 400 | |
| Example 2 | Upper edge side | 2.5 | 10.0 | 1.2 | 135 | 200 | A |
| | Lower edge side | 2.5 | 10.0 | 1.2 | 135 | 200 | |
| Example 3 | Upper edge side | 3.0 | 25.0 | 2.7 | 135 | 40 | A |
| | Lower edge side | 3.0 | 25.0 | 2.7 | 135 | 40 | |
| Example 4 | Upper edge side | 4.0 | 50.0 | 2.7 | 135 | 10 | B |
| | Lower edge side | 4.0 | 50.0 | 2.7 | 135 | 10 | |
| Comparative Example 1 | Upper edge side | — | — | — | — | — | C |
| | Lower edge side | — | — | — | — | — | |
| Comparative Example 2 | Upper edge side | 2.0 | 3.0 | 0.6 | 135 | 400 | C |
| | Lower edge side | 2.0 | 3.0 | 0.6 | 135 | 400 | |
| Comparative Example 3 | Upper edge side | 3.0 | 50.0 | 2.1 | 135 | 4 | C |
| | Lower edge side | 3.0 | 50.0 | 2.1 | 135 | 4 | |

The foregoing results showed that, when no depressed portions were formed, when the average long axis diameter Rpc-A was less than twice as long as the average short axis diameter Lpc-A, or when the number of depressed portions formed per 100 μm square was less than ten, there was a tendency for the toner to enter the contact surface between the seal member and the electrophotographic photosensitive member, and the leakage of the recovered toner was liable to occur.

Examples 5 to 7

In each of Examples 5 and 7, the surface of an electrophotographic photosensitive member was processed in the same manner as in Example 2 except that an electrophotographic photosensitive member to be processed, the long axis diameter, short axis diameter, height, vertical interval, lateral interval, and angle θ of the projected portions of a mold, and the weight average particle diameter of toner to be used in evaluation were changed as shown in Table 5. The surface shape of the photosensitive member was observed, and the photosensitive member was evaluated by a paper feeding durability test in the same manner as in Example 2. Table 6 shows the observation results of the surface shape of the photosensitive member, and the evaluation results of the paper feeding durability test.

Comparative Example 4

In Comparative Example 4, the surface of an electrophotographic photosensitive member was processed in the same manner as in Example 2 except that an electrophotographic photosensitive member to be processed, the long axis diameter, short axis diameter, height, vertical interval, lateral interval, and angle θ of the projected portions of a mold, and the weight average particle diameter of toner to be used in evaluation were changed as shown in Table 5. The surface shape of the photosensitive member was observed, and the photosensitive member was evaluated by a paper feeding durability test in the same manner as in Example 2. Table 6 shows the observation results of the surface shape of the photosensitive member, and the evaluation result of the paper feeding durability test.

Comparative Example 5

The surface of an electrophotographic photosensitive member was processed in the same manner as in Comparative Example 4 except that the pattern of a mold used for shape transfer for each of the upper edge portion and lower edge portion of the electrophotographic photosensitive member was such that a mold used in Comparative Example 4 was rotated by 90° on an axis perpendicular to the surface of the electrophotographic photosensitive member. The surface shape of the photosensitive member was observed, and the photosensitive member was evaluated by a paper feeding durability test in the same manner as in Comparative Example 4. Table 6 shows the observation results of the surface shape of the photosensitive member, and the evaluation result of the paper feeding durability test.

Comparative Examples 6 to 8

In each of Comparative Examples 6 to 8, the surface of an electrophotographic photosensitive member was processed in the same manner as in Example 2 except that an electrophotographic photosensitive member processed, the long axis diameter, short axis diameter, height, vertical interval, lateral interval, and angle θ of the projected portions of a mold, and the weight average particle diameter of toner to be used in evaluation were changed as shown in Table 5. The surface shape of the photosensitive member was observed, and the photosensitive member was evaluated by a paper feeding durability test in the same manner as in Example 2. Table 6 shows the observation results of the surface shape of the photosensitive member, and the evaluation results of the paper feeding durability test.

TABLE 5

| | Position at which surface of electrophotographic photosensitive member is processed | Short axis diameter of projected portion (μm) | Long axis diameter of projected portion (μm) | Height of projected portion (μm) | Vertical interval (μm) | Lateral interval (μm) | Angle θ (degrees) | Electrophotographic photosensitive member to be processed | Weight average particle diameter of toner (μm) |
|---|---|---|---|---|---|---|---|---|---|
| Example 5 | Upper edge side | 2.0 | 15.0 | 2.5 | 10.0 | 20.0 | 150 | A | 5.0 |
| | Lower edge side | 2.0 | 15.0 | 2.5 | 10.0 | 20.0 | 150 | | |
| Example 6 | Upper edge side | 2.0 | 15.0 | 2.5 | 20.0 | 10.0 | 100 | A | 5.0 |
| | Lower edge side | 2.0 | 15.0 | 2.5 | 20.0 | 10.0 | 100 | | |
| Example 7 | Upper edge side | 2.0 | 15.0 | 2.5 | 10.0 | 20.0 | 170 | A | 5.0 |
| | Lower edge side | 2.0 | 15.0 | 2.5 | 10.0 | 20.0 | 170 | | |
| Comparative | Upper edge side | 2.5 | 25.0 | 2.5 | 10.0 | 20.0 | 180 | A | 5.0 |
| Example 4 | Lower edge side | 2.5 | 25.0 | 2.5 | 10.0 | 20.0 | 180 | | |
| Comparative | Upper edge side | 2.5 | 25.0 | 2.5 | 20.0 | 10.0 | 90 | A | 5.0 |
| Example 5 | Lower edge side | 2.5 | 25.0 | 2.5 | 20.0 | 10.0 | 90 | | |
| Comparative | Upper edge side | 2.5 | 25.0 | 2.5 | 10.0 | 20.0 | 30 | A | 5.0 |
| Example 6 | Lower edge side | 2.5 | 25.0 | 2.5 | 10.0 | 20.0 | 30 | | |
| Comparative | Upper edge side | 2.5 | 25.0 | 2.5 | 10.0 | 20.0 | 45 | A | 5.0 |
| Example 7 | Lower edge side | 2.5 | 25.0 | 2.5 | 10.0 | 20.0 | 45 | | |
| Comparative | Upper edge side | 2.5 | 25.0 | 2.5 | 10.0 | 20.0 | 60 | A | 5.0 |
| Example 8 | Lower edge side | 2.5 | 25.0 | 2.5 | 10.0 | 20.0 | 60 | | |

TABLE 6

| | Position at which surface of electrophotographic photosensitive member is processed | (Lpc-A) (μm) | (Rpc-A) (μm) | (Rdv-A) (μm) | Angle θ (degrees) | Number of depressed portions per 100 μm square (portions) | Result of durability test |
|---|---|---|---|---|---|---|---|
| Example 5 | Upper edge side | 2.0 | 15.0 | 2.3 | 150 | 50 | A |
| | Lower edge side | 2.0 | 15.0 | 2.3 | 150 | 50 | |
| Example 6 | Upper edge side | 2.0 | 15.0 | 2.2 | 100 | 50 | B |
| | Lower edge side | 2.0 | 15.0 | 2.2 | 100 | 50 | |
| Example 7 | Upper edge side | 2.0 | 15.0 | 2.2 | 170 | 50 | B |
| | Lower edge side | 2.0 | 15.0 | 2.2 | 170 | 50 | |
| Comparative | Upper edge side | 2.5 | 25.0 | 2.3 | 180 | 50 | C |
| Example 4 | Lower edge side | 2.5 | 25.0 | 2.3 | 180 | 50 | |
| Comparative | Upper edge side | 2.5 | 25.0 | 2.2 | 90 | 50 | C |
| Example 5 | Lower edge side | 2.5 | 25.0 | 2.2 | 90 | 50 | |
| Comparative | Upper edge side | 2.5 | 25.0 | 2.2 | 30 | 50 | D |
| Example 6 | Lower edge side | 2.5 | 25.0 | 2.2 | 30 | 50 | |
| Comparative | Upper edge side | 2.5 | 25.0 | 2.3 | 45 | 50 | D |
| Example 7 | Lower edge side | 2.5 | 25.0 | 2.3 | 45 | 50 | |
| Comparative | Upper edge side | 2.5 | 25.0 | 2.3 | 60 | 50 | D |
| Example 8 | Lower edge side | 2.5 | 25.0 | 2.3 | 60 | 50 | |

The foregoing results showed that, when the angle θ formed between the long axis diameter of each depressed portion and the circumferential direction of the electrophotographic photosensitive member was 0° or 90°, there was a tendency for the toner to enter the contact surface between the seal member and the electrophotographic photosensitive member, and the leakage of the recovered toner was liable to occur. In addition, the foregoing results showed that, when the angle θ was smaller than 90°, there was a tendency for the amount of the recovered toner to be swept away toward an edge portion of the photosensitive member, and the leakage of the recovered toner was increased.

Examples 8 to 10

In each of Examples 8 to 10, the surface of an electrophotographic photosensitive member was processed in the same manner as in Example 2 except that an electrophotographic photosensitive member to be processed, the long axis diameter, short axis diameter, height, vertical interval, lateral interval, and angle θ of the projected portions of a mold, and the weight average particle diameter of toner to be used in evaluation were changed as shown in Table 7. The surface shape of the photosensitive member was observed, and the photosensitive member was evaluated by a paper feeding durability test in the same manner as in Example 2. Table 8 shows the observation results of the surface shape of the photosensitive member, and the evaluation results of the paper feeding durability test.

Comparative Examples 9 to 11

In each of Comparative Examples 9 to 11, the surface of an electrophotographic photosensitive member was processed in the same manner as in Example 2 except that an electrophotographic photosensitive member to be processed, the long axis diameter, short axis diameter, height, vertical interval, lateral interval, and angle θ of the projected portions of a mold, and the weight average particle diameter of toner to be used in evaluation were changed as shown in Table 7. The surface shape of the photosensitive member was observed, and the photosensitive member was evaluated by a paper feeding durability test in the same manner as in Example 2. Table 8 shows the observation results of the surface shape of the photosensitive member, and the evaluation results of the paper feeding durability test.

TABLE 7

| | Position at which surface of electrophotographic photosensitive member is processed | Short axis diameter of projected portion (μm) | Long axis diameter of projected portion (μm) | Height of projected portion (μm) | Vertical interval (μm) | Lateral interval (μm) | Angle θ (degrees) | Electrophotographic photosensitive member to be processed | Weight average particle diameter of toner (μm) |
|---|---|---|---|---|---|---|---|---|---|
| Example 8 | Upper edge side | 2.0 | 50.0 | 0.5 | 4.0 | 50.0 | 135 | B | 5.0 |
| | Lower edge side | 2.0 | 50.0 | 0.5 | 4.0 | 50.0 | 135 | | |
| Example 9 | Upper edge side | 10.0 | 25.0 | 2.5 | 25.0 | 25.0 | 135 | A | 5.0 |
| | Lower edge side | 10.0 | 25.0 | 2.5 | 25.0 | 25.0 | 135 | | |
| Example 10 | Upper edge side | 3.0 | 20.0 | 5.0 | 20.0 | 25.0 | 135 | A | 7.2 |
| | Lower edge side | 3.0 | 20.0 | 5.0 | 20.0 | 25.0 | 135 | | |
| Comparative Example 9 | Upper edge side | 15.0 | 25.0 | 2.5 | 25.0 | 25.0 | 135 | A | 5.0 |
| | Lower edge side | 15.0 | 25.0 | 2.5 | 25.0 | 25.0 | 135 | | |
| Comparative Example 10 | Upper edge side | 5.0 | 20.0 | 5.0 | 20.0 | 25.0 | 135 | A | 5.0 |
| | Lower edge side | 5.0 | 20.0 | 5.0 | 20.0 | 25.0 | 135 | | |
| Comparative Example 11 | Upper edge side | 1.0 | 25.0 | 2.5 | 25.0 | 25.0 | 135 | A | 5.0 |
| | Lower edge side | 1.0 | 25.0 | 2.5 | 25.0 | 25.0 | 135 | | |

TABLE 8

| | Position at which surface of electrophotographic photosensitive member is processed | (Lpc-A) (μm) | (Rpc-A) (μm) | (Rdv-A) (μm) | Angle θ (degrees) | Number of depressed portions per 100-μm square (portions) | Result of durability test |
|---|---|---|---|---|---|---|---|
| Example 8 | Upper edge side | 2.0 | 50.0 | 0.3 | 135 | 50 | B |
| | Lower edge side | 2.0 | 50.0 | 0.3 | 135 | 50 | |
| Example 9 | Upper edge side | 10.0 | 25.0 | 2.2 | 135 | 16 | B |
| | Lower edge side | 10.0 | 25.0 | 2.2 | 135 | 16 | |
| Example 10 | Upper edge side | 3.0 | 20.0 | 3.9 | 135 | 20 | B |
| | Lower edge side | 3.0 | 20.0 | 3.9 | 135 | 20 | |
| Comparative Example 9 | Upper edge side | 15.0 | 25.0 | 2.3 | 135 | 16 | C |
| | Lower edge side | 15.0 | 25.0 | 2.3 | 135 | 16 | |
| Comparative Example 10 | Upper edge side | 5.0 | 20.0 | 4.3 | 135 | 20 | C |
| | Lower edge side | 5.0 | 20.0 | 4.3 | 135 | 20 | |
| Comparative Example 11 | Upper edge side | 1.0 | 25.0 | 2.3 | 135 | 16 | C |
| | Lower edge side | 1.0 | 25.0 | 2.3 | 135 | 16 | |

The foregoing results showed that, when the average short axis diameter Lpc-A exceeded 10 μm, when the average short axis diameter Lpc-A was less than 2 μm, or when the average depth Rdv-A exceeded 4 μm, there was a tendency for the toner to enter the contact surface between the seal member and the electrophotographic photosensitive member, and the leakage of the recovered toner was liable to occur.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-194726, filed Jul. 26, 2007, which is hereby incorporated by reference herein in its entirety.

What is claimed is:

1. An electrophotographic apparatus comprising:

a cylindrical electrophotographic photosensitive member comprising a conductive support and a photosensitive layer formed on the conductive support, a charging unit, a developing unit, a transferring unit, and a cleaning unit for removing transfer residual toner by bringing an elastic member into contact with the cylindrical electrophotographic photosensitive member, wherein each of at least both edge portions of a surface layer of the cylindrical electrophotographic photosensitive member has a region where depressed portions independent of each other are formed at a density of ten or more portions per 100-μm square;

the regions where the depressed portions are formed, are arranged to be present outside a largest region where a toner image is formed, when an average depth representing a distance between a deepest portion and an opening of each of the depressed portions is represented by Rdv-A, an average short axis diameter of the depressed portions is represented by Lpc-A, and an average long axis diameter of the depressed portions is represented by Rpc-A, the average depth Rdv-A falls within a range of 0.3 μm or more and 4.0 μm or less, the Lpc-A falls within a range of 2.0 μm or more and 10.0 μm or less, and the Rpc-A is twice or more as long as the Lpc-A and 50 μm or less; and when an angle formed between a rotational movement direction of the cylindrical electrophotographic photosensitive member and a long axis of each of the depressed portions is represented by θ, the depressed portions are formed so that the angle θ satisfies a relationship of $90° < \theta < 180°$.

2. An electrophotographic apparatus according to claim 1, wherein the angle θ satisfies a relationship of $100° \leqq \theta \leqq 170°$.

3. An electrophotographic apparatus according to claim 1, wherein the depressed portions are arranged so that another depressed portion is present on a line drawn from an edge portion in a long axis direction of an arbitrary depressed portion along the rotational movement direction of the cylindrical electrophotographic photosensitive member in the regions where the depressed portions are formed.

4. An electrophotographic apparatus according to claim 1, wherein a toner to be used in the developing unit has a weight average particle diameter of 5.0 μm or more.

* * * * *